US005158376A

United States Patent [19]

Alessandro et al.

[11] Patent Number: 5,158,376

[45] Date of Patent: Oct. 27, 1992

[54] ELECTRONIC TYPEWRITER

[75] Inventors: Crotti Alessandro, Strambino; Bonmassari Gianpaolo, Ivrea, both of Italy

[73] Assignee: Ing. C. Olivetti & C., S.p.A., Ivrea, Italy

[21] Appl. No.: 780,225

[22] Filed: Oct. 22, 1991

[30] Foreign Application Priority Data

Oct. 29, 1990 [IT] Italy ..... 67833 A90

[51] Int. Cl.[5] ..... B41J 3/42; B41J 19/30

[52] U.S. Cl. ..... 400/70; 400/225; 400/248; 400/317; 400/322; 400/323; 400/568; 400/697.1

[58] Field of Search ..... 400/70, 319, 323, 324, 400/317, 225, 248, 568, 569, 697.1, 144.2

[56] References Cited

U.S. PATENT DOCUMENTS

| | | | |
|---|---|---|---|
| 4,091,911 | 5/1978 | Chang et al. | 400/70 |
| 4,111,293 | 9/1978 | Kockler | 400/322 |
| 4,181,443 | 1/1980 | Hirabayashi et al. | 400/322 |
| 4,239,400 | 12/1980 | Giolitti | 400/184 |
| 4,390,293 | 6/1983 | Gubau et al. | 400/697.1 |
| 4,469,458 | 9/1984 | Giolitti | 400/697.1 |
| 4,480,931 | 11/1984 | Kamkura et al. | 400/568 |
| 4,498,792 | 2/1985 | Falconieri | 400/697.1 |
| 4,558,965 | 12/1985 | Ueda eta l. | 400/697.1 |
| 4,572,418 | 2/1986 | Hirata | 400/568 |
| 4,575,269 | 3/1986 | Gubau | 400/322 |
| 4,681,470 | 7/1987 | Nakajima | 400/323 |
| 4,755,070 | 7/1988 | Cerutti | 400/70 |
| 4,758,108 | 7/1988 | Nakai et al. | 400/697.1 |
| 4,810,121 | 3/1989 | Uneo et al. | 400/697.1 |
| 4,986,677 | 7/1991 | Kondo et al. | 400/568 |
| 5,048,988 | 9/1991 | Nakajima et al. | 400/697.1 |

*Primary Examiner*—Eugene H. Eickholt

*Attorney, Agent, or Firm*—Banner, Birch, McKie & Beckett

[57] ABSTRACT

An electronic typewriter has a reduced number of electrically-powered actuators and comprises a motor powering a differential motion transmission unit having first and second output members. Transmission control means powered by a solenoid moves a slider to engage stop members selectively with the first and second output members to permit the second and first output members respectively to rotate. The first output member drives the carriage transport mechanism. The second output member drives the character carrying element and also powers function devices, namely a correction device, through a motion switching mechanism controlled by a switch control mechanism including another solenoid. The typing ribbon feed is driven by reciprocation of the slider between its two states. The motor is mounted on the frame and drives the motion transmission unit on a carriage through a belt; it also drives a line spacing mechanism through a clutch operated by a further solenoid. The motor and solenoids as well as the print hammer are controlled by an electronic controlling arrangement. In other alternative arrangements the motor is mounted on the carriage. A change mechanism controls the output of the motion switching mechanism so that it is applied to the correction device or to the line spacing device depending upon the direction of rotation of the motor. Instead of using a solenoid, the motion switching mechanism is engaged by a friction device driven from the first output member by driving the first output member backwards by one step. The motion switching mechanism is coupled to the line spacing device by a splined bar.

38 Claims, 14 Drawing Sheets

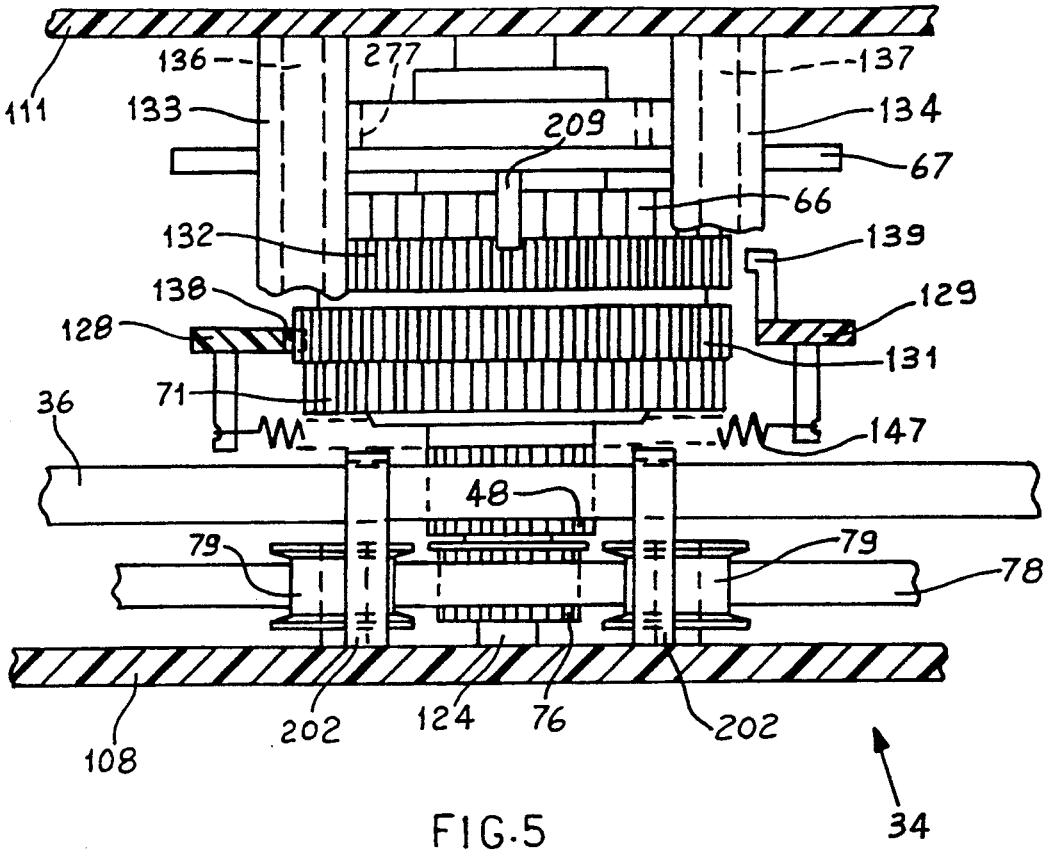
FIG.5
FIG.6
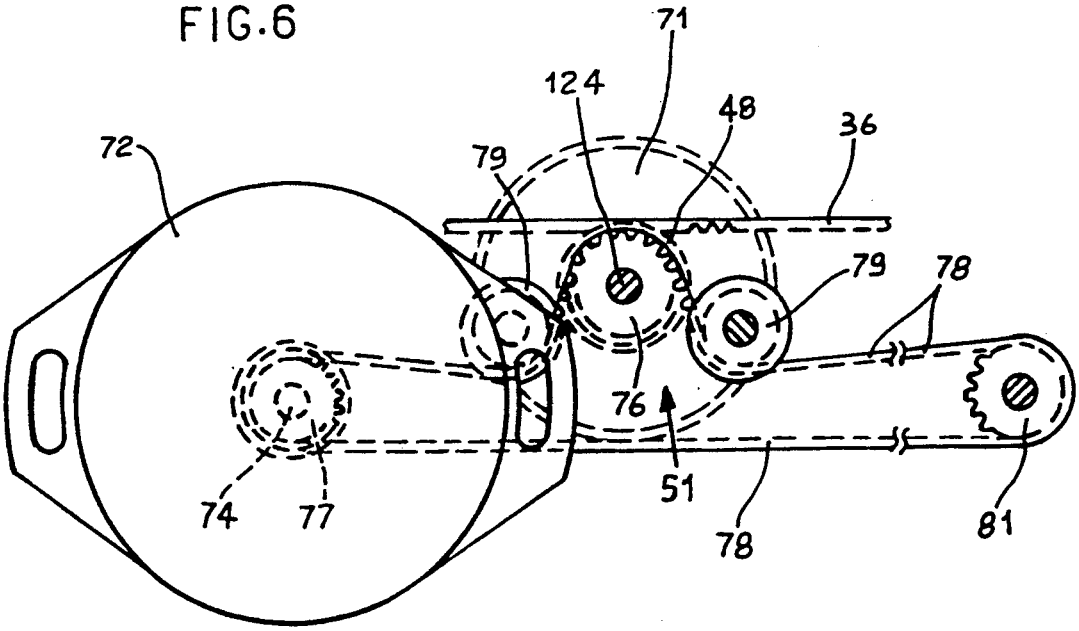

222
239
242
238
224
241
237
232
214
243
69
227
236
226
223
231
109
244

63
146
149
152
127
162
174
182
177
181
178
159
161
168
167
153
143
182
169
171
176
172
173
179
166
148
151
399
401
141
128
138
133
136
233
131
231
48
71
223
244
226
224
237
243
234
132
139
147
142
144
137
134
129
222
232
239
238

ELECTRONIC TYPEWRITER

BACKGROUND OF THE INVENTION

The present invention concerns an electronic typewriter comprising a platen roller and a carriage which is displaceable along the roller and on which are mounted a drive shaft, a rotatable character-carrying element, a transport member for displacement of the carriage and a selector shaft for selectively rotating the character-carrying element and selecting the characters to be typed. Also mounted on the carriage are one or more function devices for performing one or more functions associated with the typing of characters, a motion transmission unit having an input member connected in respect of rotary movement to the drive shaft and a first output member connected to the transport member, and transmission control means actuable into a transport state for connecting the drive shaft in respect of rotary movement to the first output member. The assembly includes an electric actuating motor for rotating the drive shaft and an electronic controlling arrangement for controlling the actuating motor, the transmission control means and the function device or devices.

A machine of that type uses a limited number of actuators such as motors and electromagnet units, and components for interfacing with the electronic controlling arrangement, in order drastically to reduce the overall cost of the machine.

An electronic typewriter with a reduced number of electromagnetic actuators is known from U.S. Pat. No. 4,239,400 assigned to Ing. C. Olivetti & C., SpA., in which the motion transmission unit is connected in respect of rotary movement to the selector shaft of the character-carrying element by means of a spring-and-ball type coupling. The transmission control means comprise a single actuation electromagnetic unit interfaced with the electronic controlling arrangement and a mechanical memory comprising a drum which is rotated by the drive shaft. The drum carries a series of selector rods which are slidable axially and which can be set by means of the actuating electromagnet, between a disengagement position and an engagement position, and the rods have radial teeth for acting on a series of couplings in response to the rotary movement of the drum. The couplings are interposed between the drive shaft and the devices to be activated and provide for execution of the various functions of the machine. Selection of the character is effected by stopping the selector shaft of the character-carrying element, by means of one of four stop levers which is suitably released by the selector rods while the drive shaft can continue to rotate for permitted disengagement of the spring-and-ball coupling. The actuating motor is capable of unidirectional motion and the mode of operation of the machine is of synchronous type. A machine of that type is slow and, while using a limited number of actuators, is costly by virtue of the complexity of the kinematic chain required for carrying out the selected functions.

SUMMARY OF THE INVENTION

An object of the present invention is to provide an electronic typewriter with a reduced number of electromechanical actuators, which is simple, reliable and of very moderate cost, in particular for typewriters of portable type.

A preferred electronic typewriter embodying the invention is provided with a motion switching mechanism having an input member connected in respect of rotary movement to a second output member of said transmission unit, and switching control means which is actuable in an operable state under the control of the electronic controlling arrangement for connecting the second output member in respect of rotary movement to said function devices for actuation thereof; wherein the transmission control means are actuable by the electronic controlling arrangement in a selection/functions state for connecting the drive shaft in respect of rotary movement to the second output member; and wherein the electronic controlling arrangement comprises means for controlling the actuating motor, causing bidirectional and selective rotary movements of the drive shaft for displacement of the carriage, for selection of the characters, and for performing function cycles of the function device or devices.

In accordance with another preferred feature the machine may use a single actuating motor for the movements of the carriage and selection of the characters by means of a differential motion transmission unit with an electromagnetic actuator selectively actuating one of two stop members to stop either the first or the second output member respectively. The actuating motor may comprise a stepper motor.

In a configuration of minimal cost and for the performance of functions which require displacement of the carriage in a backwards direction, the machine may forego an actuator, providing simple mechanisms and suitable control of the actuating motor. A line spacing device may be provided with an execution mechanism mounted on the typewriter frame and an actuating lever mounted on the carriage and linked to the execution mechanism by a splined bar.

BRIEF DESCRIPTION OF THE DRAWINGS

These and other features will be apparent from the following description of a preferred embodiment of the invention given by way of non-limiting example, with reference to the accompanying drawings in which:

FIG. 5 is a plan view of part of the machine showing details from FIG. 3 on a different scale, FIG. 6 is a front view of part of the machine showing further details from FIG. 3 on a different scale.

DETAILED DESCRIPTION OF THE PREFERRED EMBODIMENT

General Description

Figure 1:
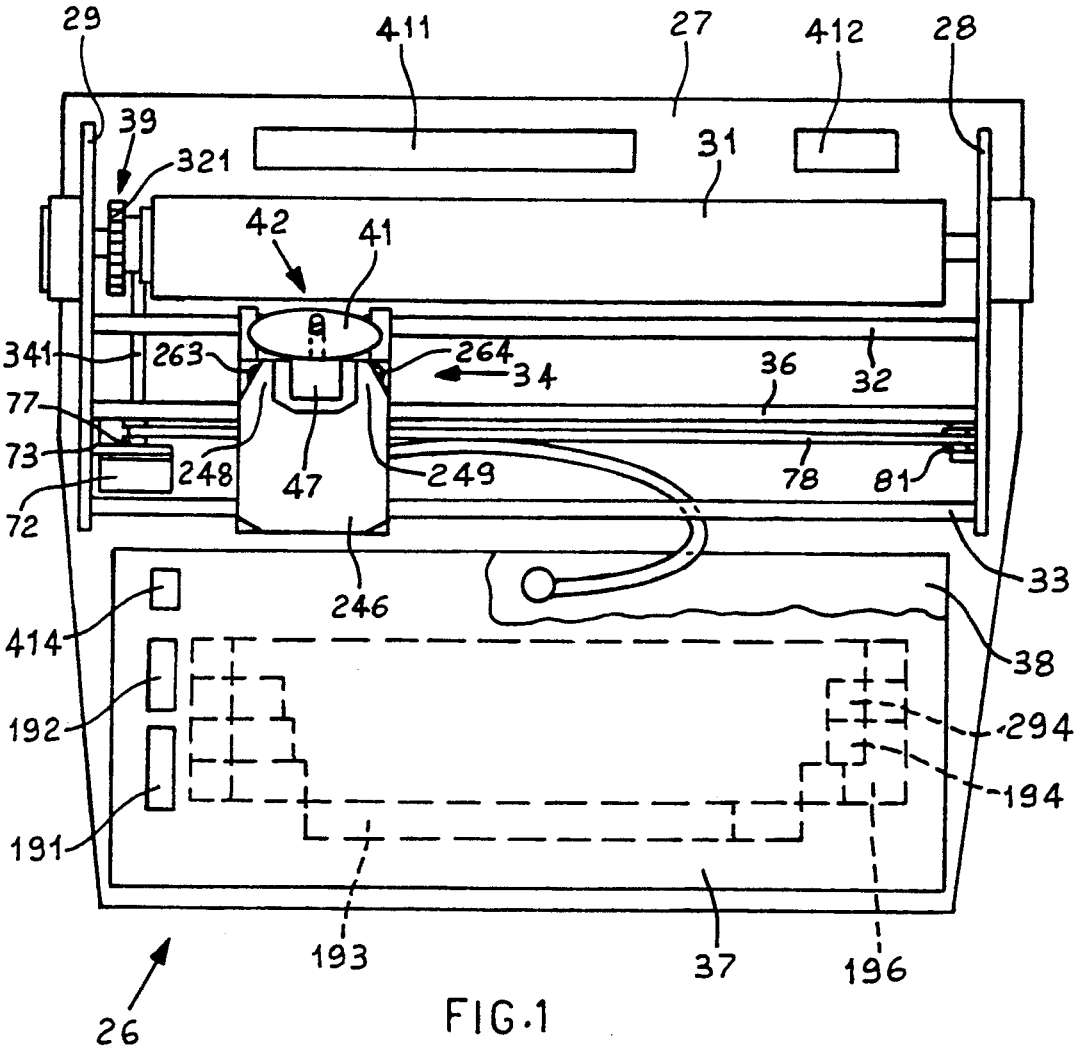
FIG. 1 is a diagrammatic view of an electronic typewriter embodying the invention.
Figure 2:
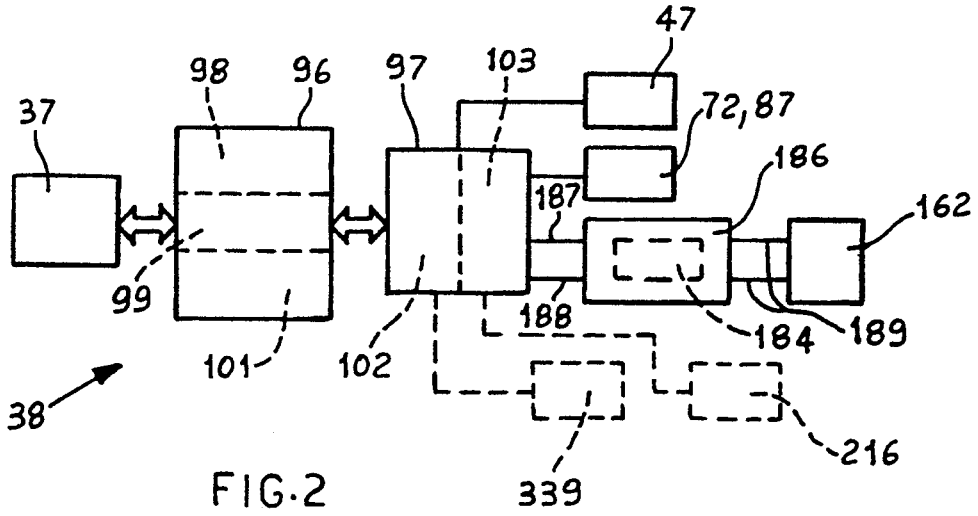
FIG. 2 is a logic block circuit diagram of a control and actuating unit of the machine shown in FIG. 1.

Referring to FIGS. 1, 2, 3, 4, 7, 8, 10 and 12, the electronic typewriter is indicated at 26 and comprises a frame structure 27 having a right-hand side portion 28 and a left-hand side portion 29 which support a typing or platen roller 31, a shaft 32 and a shaped member 33. The shaft 32 and the shaped member 33 are parallel to the roller 31 and displaceably guide a printing carriage 34 along a printing line on the roller 31. Also mounted on the frame structure 29 are a rack 36 which is also parallel to the roller 31, a keyboard 37, a board for an electronic control unit 38 and a line spacing device 39 for rotation of the platen roller 31.

Mounted on the carriage 34 are a rotatable character-carrying element 41, a selector shaft 42 of a selector device 43 for rotation of the element 41, function devices 44, 46 which are associated with typing of the characters, a print hammer 47, a transport member 48 of a transport device 49 for displacement of the carriage 34, a drive shaft 51 and a motion transmission unit 52 for selectively connecting the selector shaft 42 and the transport member 48 to the drive shaft 51 in respect of rotary movement.

The character-carrying element 41 is of the disc (or daisy wheel) type and is provided with flexible blades 53 having the print characters 54 at the ends thereof. The element 41 is keyed on the selector shaft 42 and the latter is in turn rotatable on the carriage 34 for positioning one of the characters 54 in front of a typing point 56 on the roller 31, for the printing operation.

The function devices 44, 46 comprise a typing ribbon feed device 44 and a correction device 46 for interposing a portion of typing ribbon 57 or a portion of correction ribbon 58 respectively between the element 41 and the typing point 56. The print hammer 47 provides for typing of a character 54 which is positioned in front of the typing point 56 when the typing ribbon 57 has been interposed and provides for correction of a character which has already been typed by means of re-striking same when the correction ribbon 58 has been interposed in front of the typing point 56.

The transport device 49 comprises the transport member 48 formed by a pinion which is rotatably supported on the carriage 34 and is always engaged with the rack 36 in such a way that rotary movement thereof in one direction of motion or the other correspondingly causes forward or backward displacement of the carriage 34 in accordance with a pitch which is set at the keyboard 37.

The motion transmission unit 52 (FIG. 7) comprises an input member 59 which is connected in respect of rotary movement to the drive shaft 51, a first output member 61 co-operable with the transport device 49 and connected in respect of rotary movement to the pinion 48, and a second output member 62 co-operable with the selector device 43 and connected in respect of rotary movement to the selector shaft 42. The input member 59 rotates the first or the second output member 61, 62 by means of transmission control means 63 which are in turn controlled by the electronic unit 38.

A motion switching mechanism 64 is interposed between the second output member 62 and the correction device 46 and comprises an input member 66 (FIGS. 3 and 7) connected in respect of rotary movement to the second output member 62 and an output member 67 which represents a drive member for the correction device 46. Switching control means 68, 69 can be activated under the control of the electronic unit 38 for connecting the output member 67 to the input member 66 in respect of rotary movement.

The transmission control means 63 are capable of being actuated into a transport state in which the transmission unit 52 rotates the first output member 61 and displaces the carriage 34 along the printing line, or a selection/functions state in which the transmission unit 52 rotates the character-carrying element 41 and the input member 66 of the motion switching mechanism 64. The transmission control means 63 are also connected to the typing device 44 for producing a feed movement of the typing ribbon 57 each time they change in state. In the situation in which the transmission control means 63 are in the selection/functions state and the switching control means 68, 69 are activated, rotary movement of the drive shaft 51 also causes actuation of the correction device 46 for execution of a correction cycle.

Figure 12:
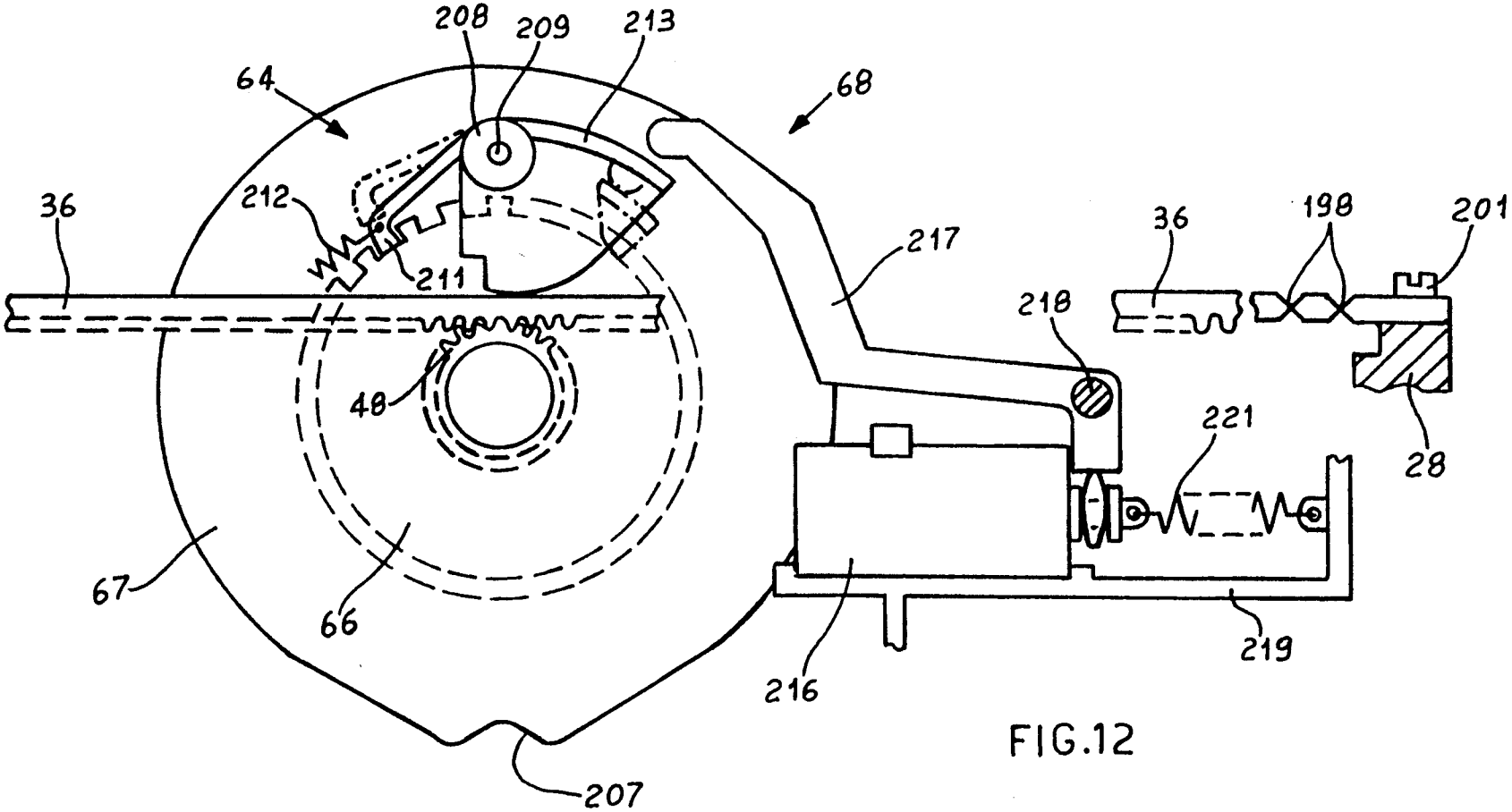
FIG. 12 is a front view showing part of a second alternative form of the machine in FIG. 1.

In a first, faster, solution as illustrated in FIG. 12, the control means 68 comprise electromagnetic means which are directly controlled by the electronic controlling unit 38.

In a second, low-cost, solution as illustrated in FIGS. 7, 8, 9 and 10, the control means 69 comprise a friction group connected to an actuating member 71 of the first output member 61 of the transmission unit 52 and indirectly controlled by the unit 38 when it rotates the first output member 61 of the unit 52 for a predetermined displacement of the carriage 34 in a backwards direction.

In the preferred embodiment illustrated in FIGS. 1, 2, 3, 4, 5, 6, 7 and 16, the drive shaft 51 on the carriage 34 receives its motion from an actuating motor 72 mounted on a plate 73 which is fixed to the side portion 29 of the frame structure 27. The output shaft 74 (FIG. 6) of the motor 72 is connected in respect of rotary movement to the drive shaft 52 which in this embodiment is formed by a pinion 76, by means of a toothed pulley 77 which is keyed on the output shaft 74, a toothed belt 78 which is always engaged with the pinion 76 which is keyed on the input member 59, pressure rollers 79 on the carriage 34 and a return pulley 81 on the side portion 28 of the frame structure 27. In this case the line spacing device 39 takes its motion from electromagnetically actuated clutch means 82 which are controlled by the unit 38, supported by the side portion 29 of the frame structure 27 and connected to the output shaft 74 of the motor 72. The motor 72 is of the stepping type and is controlled by the electronic unit 38 to rotate its output shaft 74 incrementally in the two directions of movement.

Figure 18:
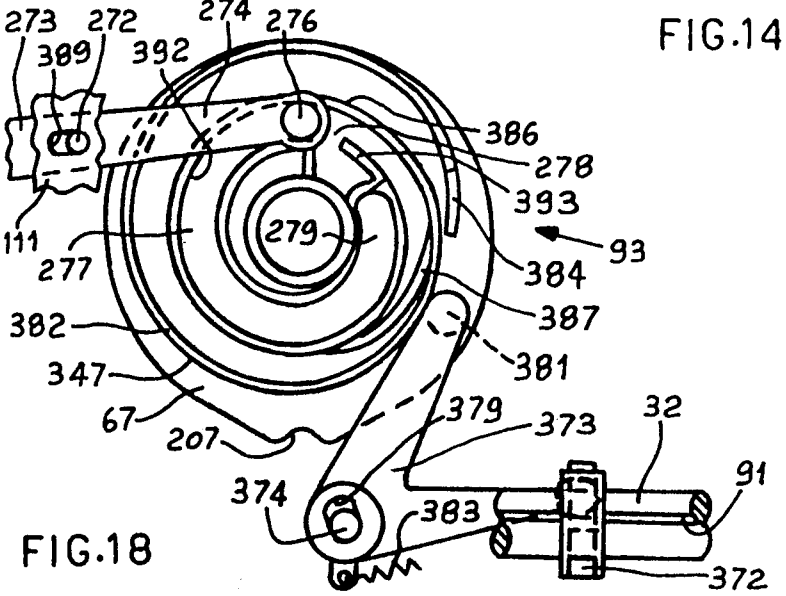
FIG. 18 is a front view of some details from FIG. 17 on a different scale.
Figure 17:
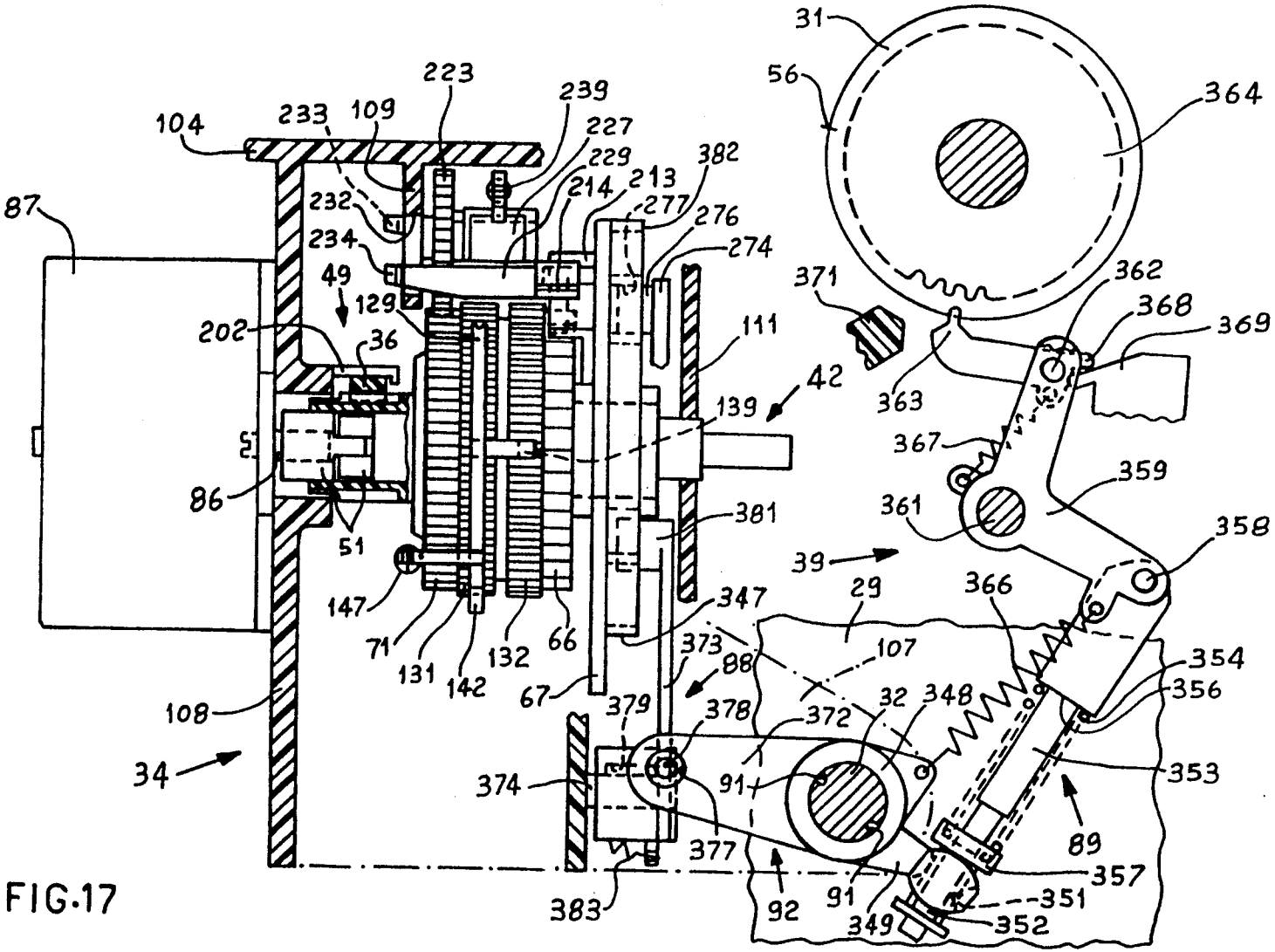
FIG. 17 shows a longitudinal view of part of a third alternative form of the FIG. 1 machine.
Figure 19:
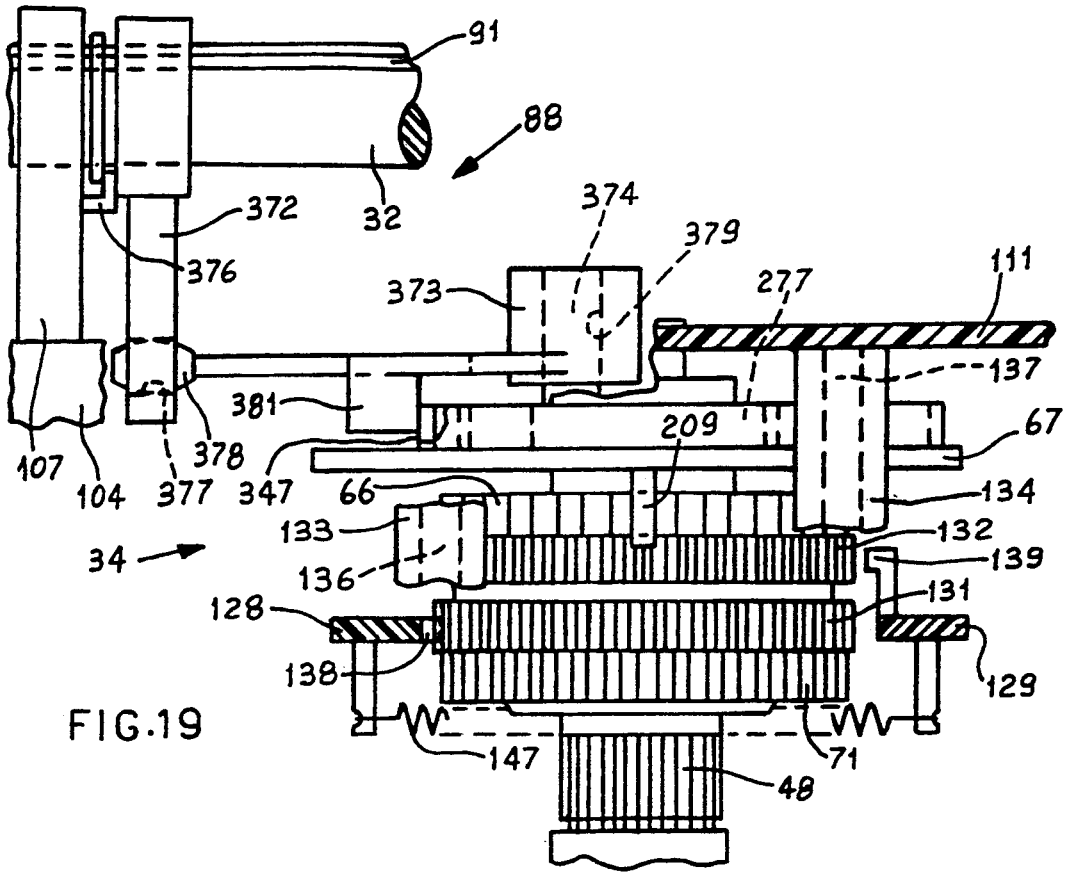
FIG. 19 shows a plan view of some arrangements from FIG. 17 on a different scale.
Figure 20:
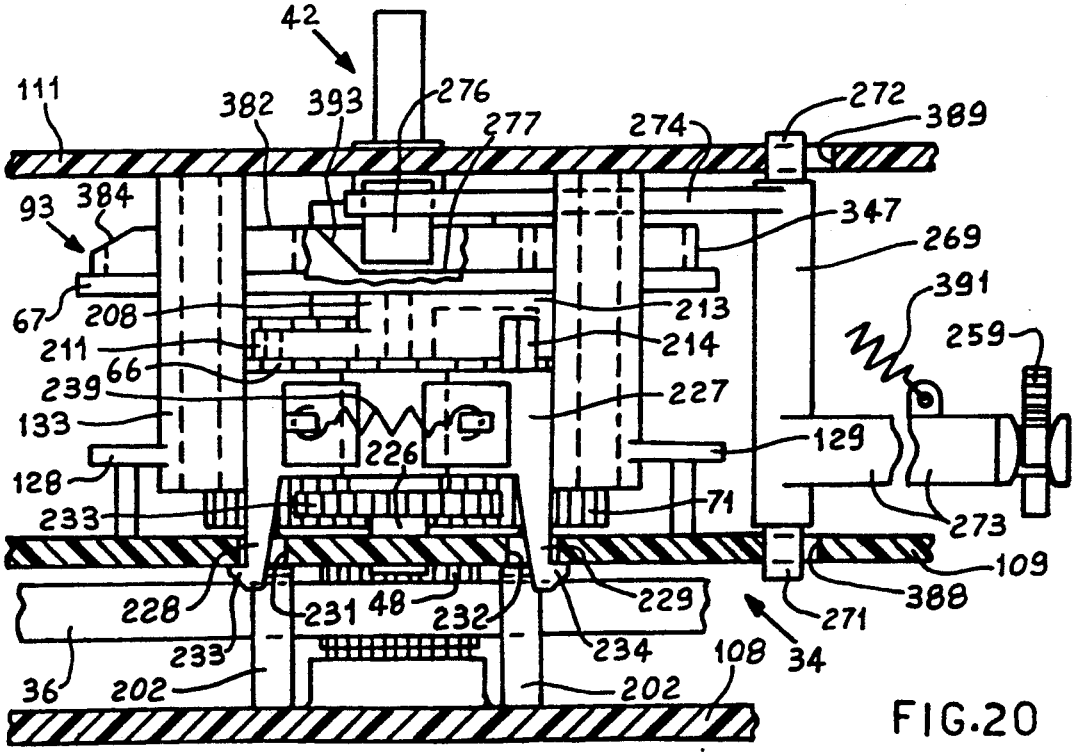
FIG. 20 shows a plan view of other arrangements from FIG. 17 on a different scale.
Figure 23:
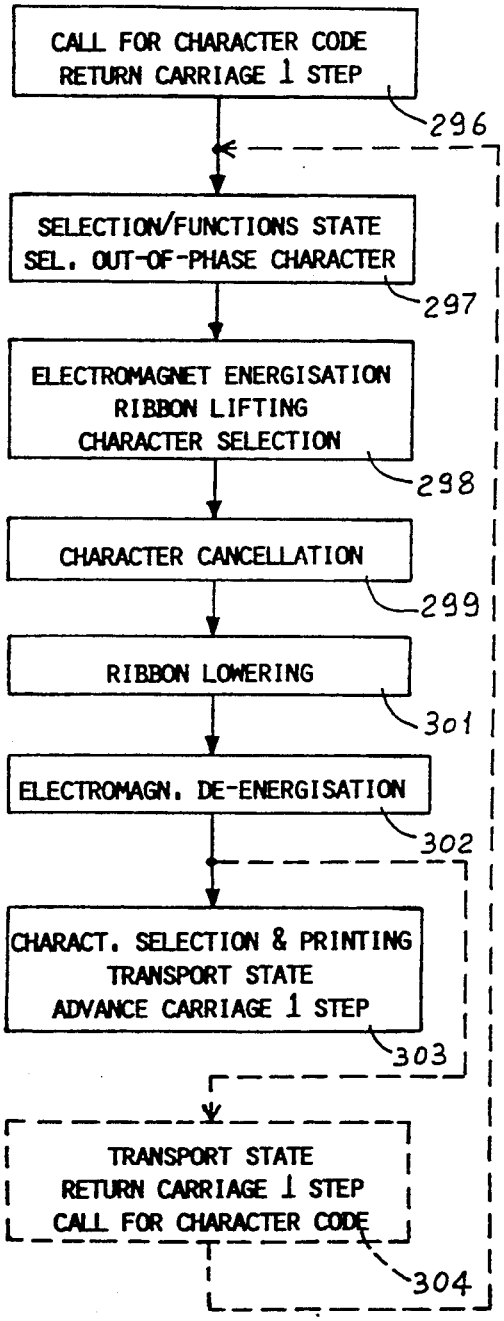
FIG. 23 shows an operating flow chart of the machine in FIG. 1 in a first solution.

In an alternative configuration, of minimal cost, as illustrated in FIGS. 17, 18 and 19, the drive shaft 51 takes its motion from an output shaft 86 of a motor 87 mounted on the carriage 34 and connected to the electronic unit 38. In the latter case, the line spacing device 39 takes its movement from a line spacing actuating mechanism 88 mounted on the carriage 34 and connecting means between the mechanism 88 on the carriage 34 and an execution mechanism 89 on the side portion 29, comprising suitable splining 91 on the shaft 32 and a coupling element 92 between the mechanism 88 and the splined shaft 32. In particular also both the correction device 46 and the actuating mechanism 88 are powered by the output member 67 of the motion switching mechanism 64 by means of a mechanism 93 for changing between line spacing and correction, responsive to the direction of movement of the second output member 62 of the transmission unit 52. The motor 87 is also of the stepping type and is bidirectionally controlled by the electronic unit 38.

The electronic unit 38 (FIGS. 1, 2, 3, 4, 8 and 12) comprises an integrated microprocessor circuit 96 connected to the keyboard 37, and a control circuit 97 connected to the integrated circuit 96 and operable to control the motor 72, 87, the transmission control means 63 and the electromagnetic control means in the event that the switching control means 68 have been adopted.

The integrated circuit 96 comprises in particular a central processing unit (CPU) 98, a read only memory (ROM) 99 with the programs for performing the various print functions and initialisation operations of the machine 26, a random access memory (RAM) 101 comprising a first location in which the codes of the last characters typed can be stored, function locations for storing the various operative conditions of the machine and position locations for storing the position of the character-carrying element 41 and the carriage 34. The control circuit 97 in turn comprises control circuit 102 and an input-output circuit 103.

The carriage 34 (FIG. 4) is generally of plastics material and comprises an upper horizontal plate 104 and two side portions 106 and 107 which are connected together by a series of transverse supports 108, 109 and 111. The carriage 34 comprises suitable bushes 112 (FIGS. 3 and 4) on the side portions 106 and 107 which are guided on the shaft 32 and a lower projection 113 on the plate 104 and capable of co-operating with a shoulder 114 on the shaped member 33, and a small wheel 116 which is rotatable on the projection 113 normally bears against the member 33.

TRANSMISSION UNIT AND ASSOCIATED CONTROL MEANS

The motion transmission unit 52 (see FIGS. 2, 3, 4, 7 and 8) comprises a differential mechanism in which the input member 59 is formed by a sleeve having at one end a pinion 117 which forms the 'sun' gear. It is positioned in a central region between two shafts 118 and 119 which are fixed with respect to the drive pinion 117 and which are coaxial with the drive shaft 51. The drive pinion 76 is keyed on the other end of the sleeve 59.

The first output member 61 is formed by a carrier which is rotatable on the sleeve 59 and on which four planet gears 121 are rotatable by means of four corresponding pins 122. The second output member 62 is formed by a sleeve which is rotatable on the shaft 118 and which has at one end an internal tooth configuration 123 which faces towards the pinion 117 and which constitutes the ring gear. The planet gears 121 are aways in engagement and in a condition of slight interference with the pinion 117 and with the internal tooth configuration 123.

The sleeve 62 has an end projecting from the shaft 118, the end being splined and defining the selector shaft 42 for the character-carrying element 41. The first output member 61 in turn has a part which is turned towards the drive shaft 51, which is shaped in such a way as to define the pinion 48 of the transport device 49. The motion transmission unit 52 is supported at one end by a shaft 124 which is fixed with respect to the transverse support 108 and at the other end by means of the sleeve 62 accommodated in a seat 126 in the transverse support 111 of the carriage 34.

Figures 8, 9:
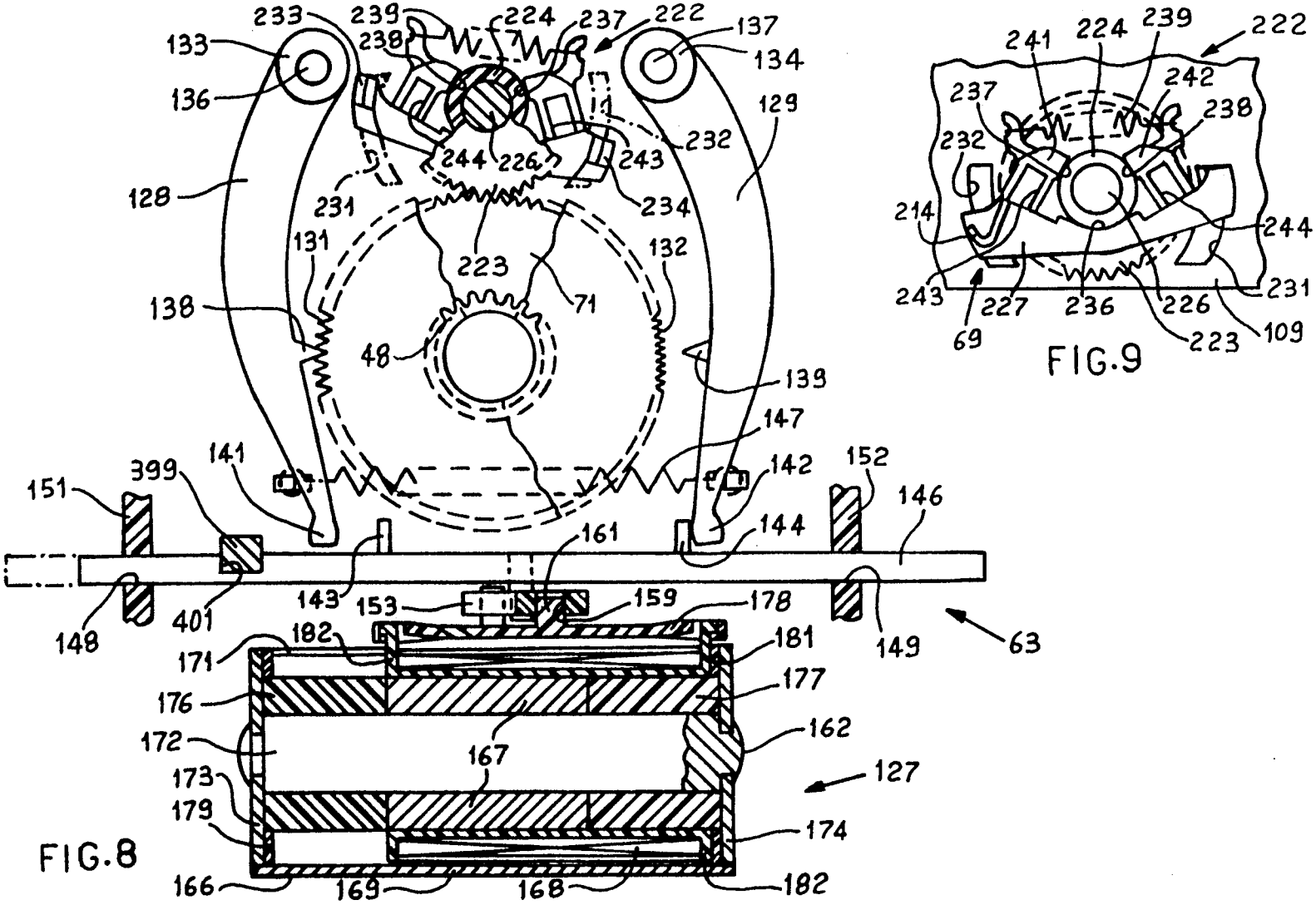
FIG. 8 is a front view of part of the machine showing some details from FIG. 3 on a different scale.
FIG. 9 is a rear view of part of the machine showing some details from FIG. 8.

The transmission control means 63 comprise electromagnetic means 127 which are actuable in the transport state and in the selection/functions state and first and second stop members 128 and 129 operatively connected to the electromagnetic means 127 (FIG. 8). In the transport state the second stop member 129 is capable of blocking the second output member 62 for transmitting the motion from the drive shaft 51 to the first output member 61 while in the selection/functions state the first stop member 128 is capable of blocking the first output member 61 to transmit the motion from the drive shaft 51 to the second output member 62. The rest condition of the machine 26 corresponds to the transport state of the electromagnetic means 127.

The two output members 61 and 62 respectively define two external toothed rings 131 and 132 of the same diameter. The two stop members 128 and 129 each comprise a sleeve 133, 134 pivotally mounted on a fixed pin 136, 137 on the support 111, a stop pawl 138, 139 co-operable with the toothed ring 131 of the first output member 61 and the toothed ring 132 of the second output member 62 respectively, and a projection 141, 142 co-operable with a limb 143. 144 of a slider 146.

A spring 147 is disposed between the two stop members 128 and 129 and tends to rotate them in opposite directions to each other in such a way as to position the two pawls 138 and 139 towards operative positions in which they are engaged with the respective toothed rings 131 and 132.

The slider 146 is slidably guided in two slots 148 and 149 in two supports 151 and 152 on the carriage 34 and is movable from a first operative position to a second operative position and vice-versa by virtue of the action of a lever 153 actuated by the electromagnetic means 127 in the transport state and in the selection/functions state. The lever 153 is rotatable on a pin 154 (FIGS. 3 and 4) on a plate 156 of the carriage 34 and comprises a first slot 157 capable of accommodating a pin 158 on the slider 146 and a second slot 159 capable of accommodating a pin 161 which comprises the actuator of the electromagnetic means 127.

In the first operative position of the slider 146, corresponding to the selection/functions state, the limb 143 is spaced from the projection 141. The spring 147 now causes the stop member 128 to rotate in the counterclockwise direction (FIG. 8), moving the pawl 138 into engagement with the toothed ring 131 of the first output member 61. The limb 144 in turn engages the projection 142, rotating the stop member 129 in the counterclockwise direction against the force of the spring 147, and holds the pawl 139 spaced from the respective toothed ring 132 of the second output member 62.

The second output member 62 can now be rotated by the drive shaft 51 in an opposite direction of movement and at a reduced speed, with respect to the shaft 51.

In the second operative position of the slider 146, corresponding to the transport state, the limb 143 engages the projection 141, rotating the stop member 128 in the clockwise direction against the force of the spring 147, and holds the pawl 138 spaced from the respective toothed ring 131. The limb 144 is disengaged from the projection 142. The spring 147 now rotates the stop member 129 in the clockwise direction, bringing the pawl 139 into engagement with the toothed ring 132 of the second output member 62. The first output member 61 can thus be rotated by the drive shaft 51 in the same direction of movement and at a reduced speed, with respect to the shaft 51.

The electromagnetic means 127 comprise a linear motor 162 supported by two parts 163 and 164 of the carriage 34. The linear motor 162 is of the double-acting type and produces identical effects in the displacement of the slider 146 in either direction. It is of the type comprising a ferromagnetic circuit 166, a permanent magnet 167 and an excitation winding 168. The magnet 167 is of radial type and is of a sleeve-like configuration, with a cylindrical external surface and a cylindrical internal surface, and it is polarised radially in such a way as to define a first polarity at its cylindrical external surface and a polarity opposite to the first polarity at its cylindrical internal surface. The ferromagnetic circuit 166 comprises a cylindrical housing 169 with splining 171, a core 172 of cylindrical shape, and two circular plates 173 and 174 which are fixed to the ends of the housing 169 and the core 172 in such a way as to dispose the core 172 coaxially with respect to the housing 169.

The core 172 and the housing 169 are of axial dimensions which are little greater than double the axial dimension of the permanent magnet 167 and the latter is fixed on the core 172 in such a way as to be surrounded by the housing 169 to define with same an air gap through which passes a radial magnetic flux generated by the permanent magnet 167. The permanent magnet 167 is mounted on the core 172 in a position which is axially centered between the two plates 173 and 174 and is held in the centered position by means of two cylindrical spacers 176 and 177 of non-magnetic material, having their cylindrical external surfaces aligned with the cylindrical external surface of the magnet 167.

The winding 168 is coaxial with the magnet 167, is accommodated in the air gap and is supported by a slide member 178. The slide member 178 is capable of bidirectional movement coaxially with respect to the permanent magnet 167 in response to bidirectional excitation currents in the winding 168. The slide member 178 comprises the projection 161 which projects from the longitudinal splining 171 of the housing 169 to engage into the second slot 159 in the lever 153 and to transmit the bidirectional movement of the slide member 178 to the slider 146. Finally, fixed on the internal walls of the plates 173 and 174 are two damper elements 179 and 181 of synthetic material for damping noise and providing a shock-absorption effect for the end of the travel movement of the slide member 178 in its bidirectional movement. In particular the slide member 178 is of non-magnetic material and comprises a flanged sleeve 182 on which the winding 168 is wound and which is guided slidably on the magnet 167 and on the spacers 176 and 177.

The excitation current in the winding 168 is of pulse type and the slide member 178 is held in the end-of-travel position by a bistable spring positioning device 183 (FIG. 4) which is known per se and which acts on the lever 153. The bidirectional excitation currents are produced by a bridge transformer 184 of an actuating circuit 186 (FIG. 2) which is controlled by the control circuit 97 of the electronic controlling unit 38 by means of a transport terminal 187 and a selection/functions terminal 188. The circuit 186 in turn activates the winding 168 of the linear motor 162 by means of flexible conductors 189 which connect the board 38 fixed on the frame structure 27 to the linear motor 162 which, in turn, is carried by the movable carriage 34.

TRANSPORT AND SELECTOR DEVICES

The stepping motor 72 (see FIGS. 1, 2, 3, 4, 5, 6, 7, 8, 10 and 12) is of the type having 48 steps and the drive shaft 51 rotates at the same angular speed as the output shaft 74 of the motor 72. The drive pinion 117, the internal tooth configuration 123 and the planet gears 121 respectively comprise 48, 100 and 26 teeth. Each rotary movement of one step of the motor 72 therefore causes a corresponding angular rotary movement of 1/174th of a revolution of the drive pinion 76 and 1/100th of a revolution of the selector shaft 42.

The transport device 49 also comprises a selector 191 on the keyboard 37, which can be set for selecting one of three spacing pitches from 1/15", 1/12" and 1/10". The basic diameter of the drive pinion 76 is about 10 mm for a corresponding displacement of the carriage 34 of about 1/60", which represents the elementary step of the carriage 34 which can be obtained with two angular steps of the motor 72. Each spacing step of 1/15", 1/12" and 1/10" will thus be obtained with 8, 10 and 12 angular steps respectively on the part of the motor 72. The number of teeth on the toothed ring 131 is 74, corresponding to the number of elementary steps performed in one revolution, to ensure constant timing as between the positions of the carriage 34 along the line of printing and the angular positions of the drive shaft 51 when the pawl 138 engages the toothed ring 131.

Under the control of the electronic unit 38 the transport device 49 can also activate displacements of 1/120" in response to a single control pulse at the motor 72, 87 for performing micrometric displacements of the carraige 34 which are required for re-printing a character in bold under the control of a selector 192 on the keyboard 37. The displacements of the carriage 34 in the forward and backward directions can also be produced by controls on the keyboard 37 comprising a space bar 193, a back-space key 194 and a carriage return key with line spacing as indicated at 196.

In the transport device 49 the rack 36 has a toothed lower part and a smooth upper part. The rack 36 is made of semi-rigid plastics and comprises two terminal portions with flexible sections and of limited thickness as indicated at 197 and 198 (FIGS. 10 and 12) which are fixed to the side portions 29 and 28 of the frame structure 27 by means of screws 199 and 201.

The pinion 48 is held in engagement with the rack 36, substantially without play by virtue of slight interference, by means of a pair of counteracting limb portions 202 (FIGS. 3 and 5) which are fixed to the transverse support 108 of the carriage 34 and which are capable of co-operating slidably against the upper part of the rack 36 at the sides of the pinion 48. The flexibility of the portions 197 and 198 permits optimum engagement as between the teeth of the rack 36 and the pinion 48 in any position of the carriage 34 along the lines of print and even in the event of errors in parallelism between the rack 36, the shaft 32 and the member 33.

The transmission ratio of 48/100 between the drive shaft 51 and the selector shaft 42 permits the use of a low-cost stepping motor and a character-carrying element 41 with 100 flexible blades, of greatly widespread type. The selector device 43 in turn comprises a support flange 203 which is fixed on the selector shaft 42 and is capable of removably fixing the character-carrying element 41 in per se known manner, as described for example in U.S. Pat. No. 4,036,348 assigned to Ing. C Olivetti & C., SpA. The number of teeth of the toothed ring 132, namely one hundred, is equal to the number of flexible blades 53 to ensure constancy of timing as between the angular positions of the element 41 and the drive shaft 51 in the event of engagement with the pawl 139.

The mode of operation of the transport device 49 and the selector device 43 is as follows, on the basis of the assumption that in the above-indicated Figures the linear motor 162 is shown in the selection/functions operative state and not the transport or rest state, with the slide member 178 positioned against the plate 174. The slider 146 is in the first operative position in which the limb 143 is spaced from the projection 141 and the spring 147 holds the pawl 138 in engagement with the toothed ring 131 of the first output member 61. The limb 144 is engaged with the projection 142 and, by virtue of the action of the spring positioning device 183 and the various intermediate elements, holds the stop member 129 rotated in a counterclockwise direction, disengaging the pawl 139 from the toothed ring 132 of the second output member 62. That means therefore that the first output member 61 is locked while the second output member 62 is free to rotate to actuate a character-carrying element selection cycle.

The microprocessor 96 which receives from the keyboard 37 the code of the character to be typed compares the present angular position of the element 41 to the desired angular position, determines the shortest direction of rotation and by way of the input-output unit 103 sends a series of control pulses to the stepping motor 72. The toothed pulley 77 now rotates in a clockwise or counterclockwise direction and, by means of the belt 78 and the pinion 76, rotates the drive shaft 51 over the shortest distance to position the selected character in front of the typing point 56.

In particular the drive pinion 76 rotates the input member 59 with the pinion 117, the planet gears 121 and the internal tooth configuration 123 on the second output member 62. The second output member 62 rotates the selector shaft 42 and the support flange 203 with the character-carrying element 41. The central unit 98, having regard to the transmission ratio between the pinion 117, the planet gears 112 and the internal toothed configuration 123, sends up to 50 switching pulses and rotates the selector shaft 42 by as many elementary steps until the character to be typed is positioned precisely in front of the typing point 56. The control circuit 97 then sends a control pulse to the print hammer 47 to cause the selected character to be hit against the roller 31.

The carriage 34 must now be moved along the typing line by a predetermined amount of a spacing step corresponding to a plurality of elementary steps for defining a fresh typing point. For that purpose the central unit 98 first sends a control pulse to the input-output unit 103 for the transport terminal 187 of the bridge transformer 184. The actuating circuit 186 energises the linear motor 162 for the transport state in such a way as to displace the slide member 178 which is positioned against the right-hand plate 174 towards the left-plate 173, against the action of the positioning device 183. The projection 161 on the slide member 178 rotates the lever 153 in the clockwise direction and the lever 153 displaces the slider 146 towards the left, positioning it in the second operative position. During that displacement the limb 144 is disengaged from the projection 142, permitting the spring 147 to rotate the stop member 129 in the clockwise direction and thus to move the pawl 139 into engagement with the toothed ring 132, locking the character-carrying element 141. The limb 143 is in turn engaged with the projection 141 and rotates the stop member 128 in the clockwise direction against the force of the spring 147, positioning the pawl 138 at a spacing from the respective toothed ring 131.

Under those circumstances, with the linear motor 162 in the transport state, the machine 26 is in its natural rest state to which there corresponds an operative state of the transmission unit 52 in which the first output member 61 is free to rotate while the second output member 62 remains blocked. By way of the input-output unit 103, the central unit 98 passes 8, 10 or 12 control pulses to the stepping motor 72 in dependence on the spacing pitch set. The motor 72, by means of the belt 78, rotates the drive pinion 76, the input member 59, the pinion 117, the planet gears 121, the first output member 61 and the pinion 48. As the pinion 48 is engaged with the rack 36, as it rotates it causes the carriage 34 to advance along the typing line by the set amount.

If a new character selection code arrives from the keyboard 37, the central unit 98, by means of the input-output unit 103, passes a control pulse to the terminal 188 of the bridge transformer 184 for predisposition of the selection/functions state. The actuating circuit 186 energises the linear motor 162 and causes displacement of the slide member 178 towards the right-hand plate 174. The pin 161 of the slide member 174 rotates the lever 153 in the counterclockwise direction, the lever 153 causing the slider 146 to move towards the right, positioning it in the first operative position as shown in FIG. 8 and as described hereinbefore. The first output member 61 is now locked while the second output member 62 is free to rotate. At that point the sequence is repeated for that new selection cycle, which is substantially the same as described hereinbefore and which terminates with the return movement of the linear motor 162 and the unit 52 to the transport state.

In the event that a transport code arrives from the keyboard 37 in response to actuation of the bar 193 or one of the keys 194 or 196 the central unit 98 will activate the motor 72 only for displacement of the carriage 34 by a distance associated with that of the actuated key.

MOTION SWITCHING MECHANISM AND ASSOCIATED CONTROL

The motion switching mechanism 64 (FIGS. 1, 2, 3, 5, 7, 8, and 9, and especially 10 and 12) comprises a tooth-type coupling in which the input member 66 comprises a drive portion formed by a toothed wheel which is fixed with respect to the second output member 62 of the motion transmission unit 52.

The output member 67 of the motion switching mechanism 64 comprises a driven portion formed by a drive member rotatable on a sleeve 204 (FIG. 7) fixed with respect to the second output member 62. The drive member 67 is held in a rest position by the action of a resilient blade 206 (FIG. 10) on the carriage 34, which is engaged in a recess 207 in the drive member 67.

A coupling closure element 208 (FIGS. 10 and 12) is mounted on the drive member 67 and is displaceable from an inoperative position to an operative position to connect the toothed wheel 66 and the drive member 67 in respect of rotary movement. The coupling closure element 208 is rotatable on a pin 209 on the drive member 67 and comprises a pawl or latch 211 capable of engaging with the teeth of the toothed wheel 66 under the force of a spring 212, and a limb 213 positioned opposite the pawl 211 and co-operable with a switching control element 214 which can be activated by switching control means 68 or 69 under the control of the electronic unit 38.

In accordance with the first solution, the switching control means 68 (FIG. 12) comprise an electromagnet 216 and a lever 217 pivoted on a pin 218 on the carriage 34 and movable between first and second positions associated with a deactivated and an activated condition respectively of the electromagnet 216. In the first position the lever 217 engages the limb 213 in the position shown in dash-dotted line in FIG. 12 to hold the coupling closure element 208 rotated in an inoperative position, against the force of the spring 212. In the second position the lever 217 is disengaged from the limb 213 and the spring 212 displaces the coupling closure element 208, putting it in the operative position shown in solid lines in which the pawl 211 is engaged into a space between two teeth of the toothed wheel 66, thereby to hold the component 66 and the component 67 together in respect of rotary movement.

The electromagnet 216 is fixed on a support 219 of the carriage 34 and a spring 221 anchored to the support 219 tends to rotate the lever 217 towards the first position. The electromagnet 216 is directly controlled by the electronic unit 38.

In its rest state the electromagnet 216 is de-energised and the spring 221 holds the lever 217 in the first position in which the coupling closure element 208 is in the inoperative position. When the electromagnet 216 receives an energisation current, it positions the lever 217 in its second position against the force of the spring 221, permitting the spring 212 to position the coupling closure element 208 in the operative position in which the pawl 211 is engaged into a space between two teeth of the toothed wheel 66.

FIG. 12 shows in solid lines the condition in which the electromagnet 216 is energised, the lever 217 is in the second position and the coupling closure element 208 is in the operative position.

The mode of operation of the control means 68 of the first construction described above is as follows, based on the assumption that performance of the function associated with printing requires the transmission unit 52 to be in the selection/functions state in which the second output member 62 and thus the toothed wheel 66 are connected to the drive shaft 51 in respect of rotary movement.

The central unit 98 which receives from the keyboard 37 the code of the service function to be performed by means of the input-output unit 103 switches the linear motor 162 for the selection/functions state and as a preliminary step passes an energisation current to the electromagnet 216. The electromagnet 216 positions the lever 217 in the second position against the force of the spring 221, permitting the spring 212 to rotate the coupling closure element 208 into the operative position in which the pawl 211 engages into a space between two teeth of the toothed wheel 66 and fixedly connects the toothed wheel 66 and the drive member 67 together.

The central unit 98 now passes control pulses to the motor 72 for rotation of the drive shaft 51. The drive shaft 51 in turn rotates the input member 59, the pinion 117, the planet gears 212, the internal tooth configuration 123 and the second output member 62 with the toothed wheel 66 and the drive member 67. The drive member 67 in turn activates the function selected under the control of the unit 38, as described hereinafter, and each rotary movement of the drive member 67 through 360° will correspond to a cycle of performance of the selected function. As soon as the control pulses from the central unit 98 stop, the drive member 67 stops in its rest position. The central unit 98 will effect de-energisation of the electromagnet 216 and the spring 221 will return the lever 217 to the first position in which the coupling closure element 208 is in the inoperative position and the drive member 67 is disengaged from the toothed wheel 66.

In the second, low-cost, solution, the switching control means 69 (FIGS. 1, 2, 3, 4, 5, 7, 8, 9, 10 and 20) comprise a friction group 222 (FIG. 9) connected to the actuating member 71 of the first output member 61 of the transmission unit 52 and the switching control element 214 which comprises the L-shaped projection co-operable with the limb 213 of the coupling closure element 208.

Figure 10:
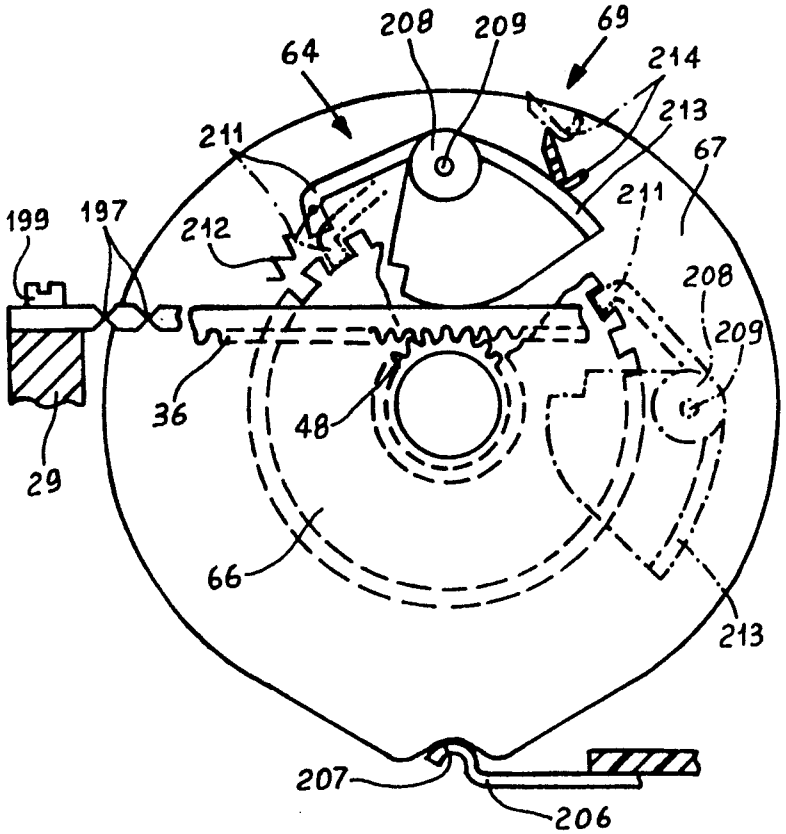
FIG. 10 is a front view showing part of a first alternative form of the machine in FIG. 1.

The electronic unit 38 activates the friction group 222 not in a direct fashion but by causing a return cycle of the carriage 34 by one step. The L-shaped projection 214 is movable between a first position in which it holds the coupling closure element 208 rotated in the inoperative position, and a second position in which it is disengaged from the limb 213 and permits the spring 212 to move the coupling closure element 208 into the operative position. In FIG. 10 the L-shaped projection 214 is shown in solid line in the first position and in dash-dotted line in the second position.

The friction group 222 comprises, as the drive component, a toothed sprocket wheel or pinion 223 (FIGS. 9 and 20) always engaged with the actuating member 71 which comprises a gear which is fixed with respect to the first output member 61. The pinion 223 is fixed with respect to a sleeve 224 rotatable on a pin 226 on the support 109 of the carriage 34 and co-operates with a friction element 227 which is fixed with respect to the L-shaped projection 214 and which represents the driven component of the friction group 222. The friction element 227 extends along the sleeve 224 and comprises two limbs 228 and 229 at one end and the L-shaped projection 214 at the opposite end. The two limbs 228 and 229 are accommodated and guided by corresponding slots 231 and 232 in the support 109 and each terminate with a latch 233 and 234 for preventing disengagement of the two limbs 228 and 229 from the slots 231 and 232.

The friction element 224 has a central body of rocker arm configuration, which is open upwardly and which comprises a lower contact surface 236 and two upper contact surfaces 237 and 238 which are disposed at 120° relative to each other and which are capable of co-operating with the external surface of the sleeve 224. A spring 239 is tensioned between the portions 241 and 242 and two spaces 243 and 244 positioned adjacent the contact surfaces 237 and 238 are capable of permitting reciprocal flexural displacement as between the portions 241 and 242 in such a way that the contact surfaces 236, 237 and 238 are always against the external surface of the sleeve 224, under the force of the spring 239.

The pinion 223, always being engaged with the gear 71 which is fixed with respect to the first output member 61, is entrained in rotation whenever the first output member 61 rotates. The sleeve 224 rotates with the pinion 223, the sleeve 224 providing for frictional transmission of the motion of the friction element 227 by means of the contact surfaces 236, 237 and 238 and due to the force of the spring 239, causing the element 227 to rotate in the same direction of rotation as the sleeve 224. However, the two slots 231 and 232 limit the angular displacement of the respective limbs 228 and 229 and thus of the friction element 227 and define the first and second positions of the L-shaped projection 214. When the maximum rotary movement permitted to the element 227 is exceeded, the rotary movement of the pinion 223 causes the external surface of the sleeve 224 to slip against the contact surfaces 236, 237 and 238. In the rest condition the L-shaped projection 214 is in the first position and holds the pawl 211 in the inoperative position against the force of the spring 212. The frictional forces between the element 227, the pinion 223, the toothed wheel 66, the pinion 48 and the rack 36 prevent the spring 212 from being able to displace the pawl 211 from its inoperative position to the operative position.

If the pinion 223 rotates in the clockwise direction in FIG. 8, corresponding to a counterclockwise rotary movement of the output member 61 and a forward feed motion of the carriage 34, the friction element 227 remains held with the limb 228 against the bottom of the respective slot 231 and with the L-shaped projection 214 positioned in the first position. If, however the pinion 223 rotates in the counterclockwise direction in FIG. 8, corresponding to the return movement of the carriage 34 by one step (four elementary steps), the friction element 227 is entrained with a rotary movement until it is stopped with the other limb 229 against the bottom of the respective slot 232 and with the L-shaped projection 214 in its second position. For further rotary movements of the first output member 61, the pinion 223 continues to rotate with the gear 71 in accordance with the control pulses at the motor 72, which are received from the electronic unit 38, the element 227 remains stopped and slip occurs between the external surface of the sleeve 224 and the contact surfaces 236, 237 and 238.

The mode of operation of the second construction is as follows, on the same basis as the first construction, namely that the transmission unit 52 is in the transport state.

When the central unit 98 receives the code of the function to be performed from the keyboard 37, the code initiates a sequence which first provides for activation of the stepping motor 72 to actuate a cycle involving return movement of the carriage 34 by one step. For that purpose the microprocessor 96 passes a group of control pulses to the stepping motor 72 by means of the input-output unit 103 in dependence on the spacing pitch set at the keyboard. The motor 72 rotates the drive shaft 51, the input member 59, the pinion 117, the planet gears 121, the first member 61 and the pinion 48.

The pinion 48 always being engaged with the rack 36, when it rotates it causes the carriage 34 to return along the typing line by the distance controlled by the central unit 98, which in the specific case considered here is one step. The gear 71 and thus the pinion 223 rotate with the first output member 61; the gear 223, by means of the sleeve 224, rotates the friction element 227 until it is stopped with the limb 229 against the bottom of the respective slot 232, positioning the L-shaped projection 214 in the second position. In that second position, the L-shaped projection 214 is disengaged from the limb 213 and the spring 212 rotates the coupling closure element 208, moving it into the operative position, with the pawl 211 engaged in a space between two teeth of the toothed wheel 66.

By means of the circuit 97 the microprocessor 96 activates the terminal 188 and the bridge transformer 184 to predispose the linear motor 162 in the selection/-functions state. As soon as the linear motor 162 receives the energisation current from the line 188, the slide member 178 is displaced towards the right-hand circular plate 174 against the action of the positioning device 183. The pin 161 on the slider member 178 rotates the lever 153 counterclockwise, which causes the slider 146 to slide towards the right, being positioned in the first operative position in which the pawl 138 is engaged with the respective toothed ring 131 while the pawl 139 is disengaged from the respective toothed ring 132. The first output member 61 is locked while the second output member 62 is free to rotate. That state is maintained by the positioning device 183 when the excitation current applied to the winding 168 ceases.

The central unit 98 now passes control pulses by means of the input-output unit 103 to the motor 72 which rotates the drive shaft 51 in the clockwise or counterclockwise direction and by the desired amount, depending on the operational code received from the keyboard 37. The motor shaft 51 rotates the input member 59, the pinion 117, the planet gears 121, the internal tooth configuration 123 and the second output member 61 with the toothed wheel 66 and the drive member 67. The drive member 67 actuates a function cycle in each rotary movement of 360°, as will be described hereinafter. The central unit 68 terminates the control pulses when the drive member 67 is stopped in its rest position in which the resilient blade member 206 on the carriage 34 is engaged into the recess 207 in the control member 67.

The central unit 98 now produces a transport cycle for advancing the carriage 34 by one step. As described hereinbefore, it predisposes the linear motor 162 in the transport state, moving the slide member 178 toward the left-hand plate 173, being the state in which it frees the first output member 61 and locks the second output member 62. Subsequently, by means of the stepping motor 72, it causes the carriage 34 to advance by one step. As a consequence of that advance movement, the friction element 227 is entrained in rotation and it positions the L-shaped projection 214 in its first position.

Here it is engaged with the limb 213 and positions the coupling closure element 208 in the inoperative position with the pawl 211 disengaged from the teeth of the toothed wheel 66.

The electronic typewriter 26 can make use of the first construction 68 or the second construction 69 and the microprocessor 96 is correspondingly predisposed to control the construction which is actually employed. When the second, lower-cost, construction 69 is used, selection at the keyboard 37 of the function involving a return movement by one step would cause simultaneous predisposition for performance of a function, by virtue of closure of the coupling of the mechanism 64. In order to ensure therefore that, after the return movement of the carriage 34 by one step, the toothed coupling cannot remain closed, the microprocessor 96 activates the motor 72 for a sequence which provides for backwards displacement of the carriage 34 not by a single step but by two spacing steps, which are immediately followed by a displacement in a forward direction, such as to cause the toothed coupling of the mechanism 64 to re-open.

TYPING AND CORRECTION DEVICES

Figure 3:
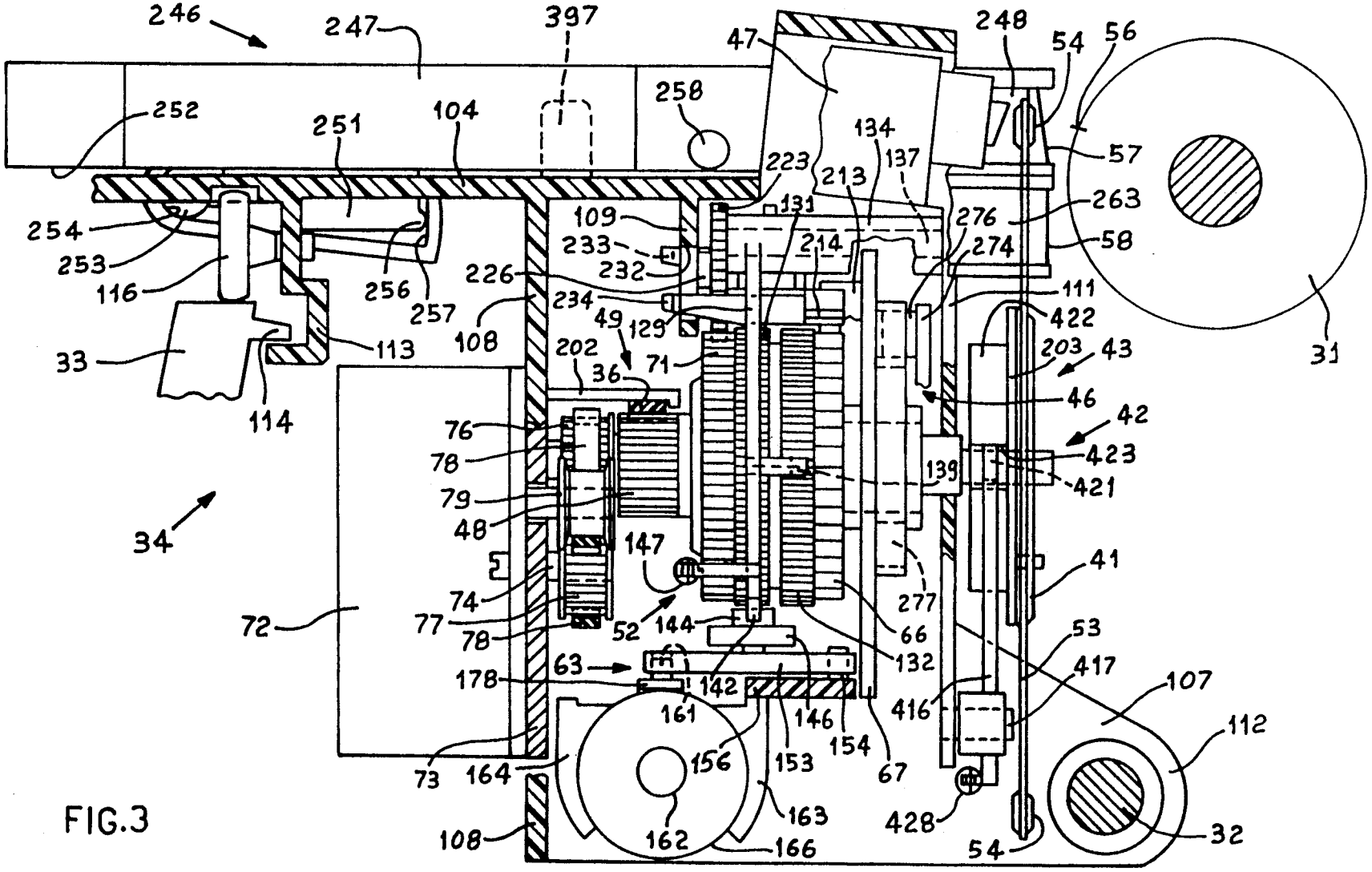
FIG. 3 is a longitudinal view of part of the machine shown in FIG. 1.
Figure 4:
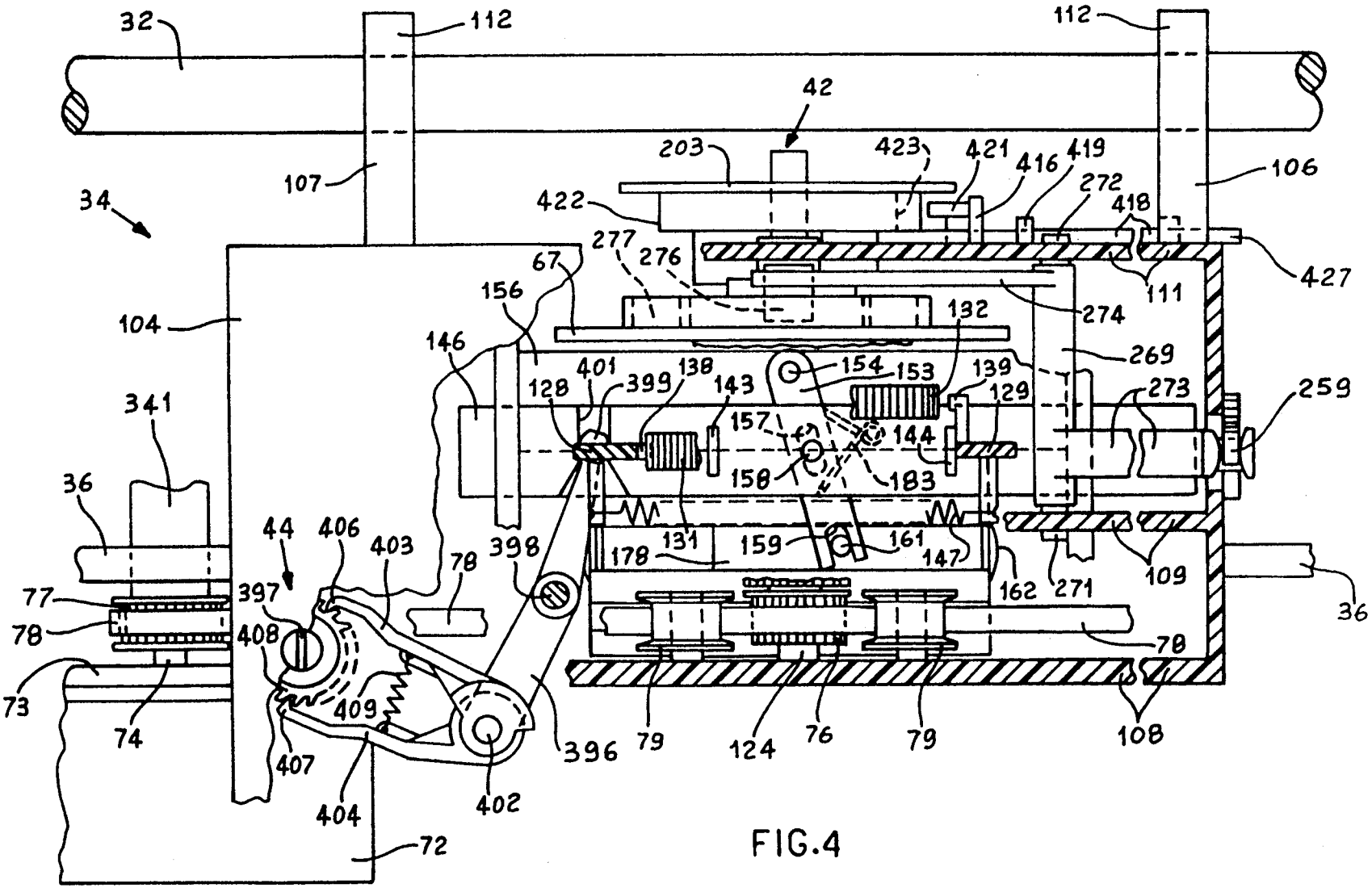
FIG. 4 is a plan view of part of the machine shown in FIG. 1.
Figure 7:
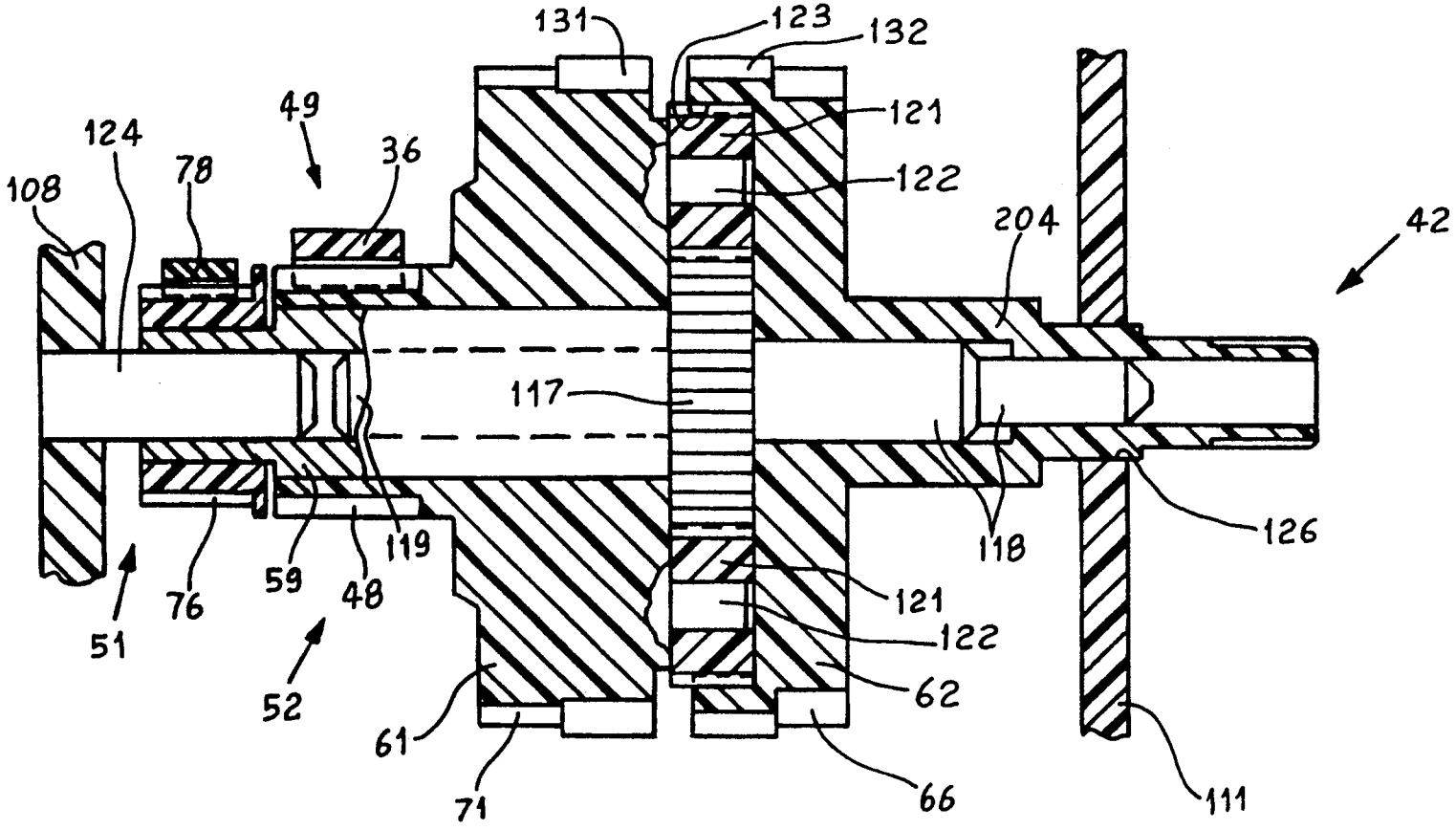
FIG. 7 is a front view in section of some details from FIG. 3 on a different scale.

The typing device 44 (FIGS. 1, 2, 3, 4, 7, 8, 9, 10, 12, 13, 14, 20, 23 and 24) comprises a cartridge 246 (FIGS. 3 and 13) having a casing 247 for accommodating the typing ribbon 57 and two arms 248 and 249 which project from the casing 247 to position a portion of the typing ribbon 57 on the outside of the casing. The cartridge 246 also comprises two guide elements 251 which project from a bottom 252 and which at one end each have a pin 253 capable of being accommodated in a semicylindrical seat 254 in the carriage 34 and at another end a shoulder 256 co-operable with a counteracting wall 257 of the carriage 34. The cartridge 246 is mounted removably with respect to the seats 254 and the wall 257 by means of a pin 258 projecting laterally from the arm 249 and a lever 259 on the carriage 34, which is substantially vertical and which engages the pin 258, by means of a seat 261 and by virtue of the force of a spring 262. In a rest condition the lever 259 is in a position such that the external portion of the typing ribbon 57 is in front of the typing point 56 and is ready for printing of the characters 54 (FIG. 3).

The correction device 46 comprises a feed reel 263 on which the correction ribbon 58 still to be used is wound and a take-up reel 264 on which the ribbon 58 is rewound after having been used. The two reels 263 and 264 (FIGS. 1, 3 and 13) are supported rotatably by corresponding pins 266 projecting from the bottom 252 of the cartridge 246. The arms 248 and 249 of the cartridge 246 comprise two guide elements 267 which project downwardly therefrom and which are arranged to guide a portion of the correction ribbon 58 below the external portion of the typing ribbon 57 in coplanar relationship therewith. For positioning the ribbon 58 in the correction phase, the cartridge 246 is capable of oscillating movement about an axis which is parallel to the roller 31. For that purpose the semicylindrical seats 254 are coaxial with each other and define the axis of oscillating movement of the cartridge 246. The wall 257 is curved and has an axis of curvature which is coincident with the axis of the seat 254. The lever 259 is guided by guides 268 to move in a plane perpendicular to the roller 31 and is displaceable vertically and by means of the pin 258 can cause the cartridge 246 to oscillate about its axis until the correction ribbon 58 is moved into a position in front of the typing point 56.

The correction device 46 comprises an actuator 269 (FIGS. 4 and 14) formed by a rocker arm lever which is pivotally mounted by means of two pins 271 and 272 on the supports 109 and 111 of the carriage 34, parallel to the selector shaft 42. The lever 269 comprises a first arm 273 to which a lower end of the lever 259 is pivotally connected and a second arm 274 provided with a cam follower pin 276 engaged with a correction cam 277 carried by the drive member 67.

The cam 277 is of the channel type for positive displacement of the cam follower pin 276, extends over about 300° with a spiral configuration and comprises a sector 278 of maximum lift and a sector 279 of minimum lift. The sectors 278 and 279 are angularly spaced by about 270° corresponding to a fraction of 75/100 ths of a revolution. In the rest condition the cam follower pin 276 engages the sector 278 of maximum lift, which predisposes the printing condition, and at the same time the rest condition of the cartridge 246 in which the correction ribbon 58 is below the typing point 56.

For the feed movement of the correction ribbon 58 the device 46 comprises a ratchet member 283 (FIG. 13) which is pivotally mounted on the carriage 34 parallel to the platen roller 31 with its semicylindrical end 284 accommodated in a seat 286 on the carriage 34. The ratchet member 283 is provided with two spaced-apart arms 287 and 288 which have respective latches 289 and 291 which are diametrally opposite to each other and co-operable with the teeth of a toothed ring 292 which is fixed with respect to the lower part of the take-up reel 264. A spring 293 holds the ratchet member 283 in a condition of always being rotated upwardly in such a way that the latches 289 and 291 are always engaged with the teeth of the toothed ring 292 when the cartridge 246 is mounted on the carriage 34. The two latches 289 and 291 are positioned in opposite relationship to each other in such a way that during a phase involving a lifting movement of the cartridge 246, the first latch 289 entrains a first tooth and the second latch 291 passes over a second tooth, while in a phase involving a downward movement of the cartridge 246, the first latch 289 passes over a tooth adjacent to the first tooth and the second latch 291 pushes the second tooth, causing the take-up reel 264 always to be rotated in the same direction for the unidirectional feed movement of the correction ribbon 58.

The correction device 46 is associated with a correction key 294 on the keyboard 37. In the event that the key 294 has been actuated immediately after printing of a character, the microprocessor 96 causes a return movement of the carriage 34 by one step, recall from the memory 101 of the code of the last character typed, predisposition for positioning of the correction ribbon 58 in front of the typed character, selection of the character to be corrected, and printing of that character with the interposition of the correction ribbon 58, until the character is cancelled. The correction cycle does not provide for subsequent displacement of the carriage 34 in a forward direction to permit typing of the correct character in the same position as that in which the cancelled character was typed, or cancellation of an adjacent character disposed after the first.

The operative sequences vary according to whether the motion switching mechanism 64 comprises the first construction with the electromagnet 216 or the second construction with the friction group 222. The operative sequences relating to the first and second constructions are shown in brief in the charts illustrated in FIGS. 23 and 24.

The mode of operation of the correction device 46 is as follows, on the assumption which has already been made that the transmission unit 52 is in the transport state, and with consideration of a specific example of a correction operation. It shall be assumed that the operator wanted to type the letter '1', but that the letter 'A' was typed. The carriage 34 is displaced by a spacing step from the letter 'A' along the printing line.

In the case of a machine 26 which adopts the first construction, actuation of the key 294 on the keyboard 37 causes by means of the microprocessor 96 a return movement of the carriage 34 by a spacing step, by means of 8–12 pulses being passed to the motor 72, in dependence on the pitch set. The carriage 34 is displaced, block 296 on FIG. 23, in a backward direction by a spacing step to the character 'A' to be corrected. The microprocessor 96 now switches the linear motor 162 into the selection/functions state, block 297, positioning the slide member 178 towards the right-hand plate 174, in which the first output member 61 is locked and the second output member 62 is free to rotate. The central unit 98 also activates the motor 72 with 25 switching pulses such as to rotate the second output member 62 with the character-carrying disc 41 for a selection cycle, at the end of which the character 'A' to be re-struck is angularly out of phase with respect to the typing point 56 by a value (270°) equal and opposite to the angular distance between the sectors 278 and 279. In the block 298 the central unit 98 causes energisation of the electromagnet 216 so that the coupling closure element 208 is positioned in the operative position by the spring 212, connecting the drive member 67 to the second output member 62 in respect of rotary movement. The central unit 98 then activates the motor 72 in the opposite manner to that effected in the block 297 to rotate the second output member 62, the character-carrying disc 41 and the drive member 67 in the clockwise direction with reference to FIG. 14. The drive member 67 rotating with the cam 277, it engages the cam follower pin 276 with the decreasing lift from the sector 278 to the sector 279 and produces clockwise rotation of the actuator 269. The first arm 273 raises the lifting lever 259 and the latter in turn lifts the cartridge 246 into the correction position, thereby positioning the correction ribbon 58 in front of the typing point 56. At the same time the character-carrying disc 41 rotates angularly and recovers the angle by which the character 'A' to be re-struck was out of phase so that after 75 switching pulses the character 'A' is in front of the typing point 56.

In block 299 the central unit 98 causes a print cycle by actuating the striker electromagnet 47 and moving the character 'A' to be struck with the correction ribbon 58 against the roller 51, thus cancelling the character 'A'.

Figure 14:
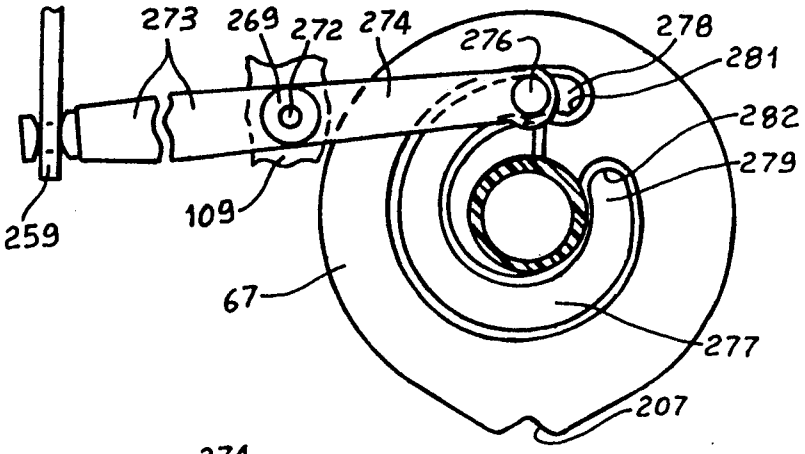
FIG. 14 is a front view of part of the machine showing some details from FIG. 4 on a different scale.

In block 301 the central unit 98 activates the motor 72 with a further 75 pulses, as has already happened in the block 297, in such a way as to rotate the second output member 62 with the character-carrying disc 41 and the drive member 67 in a counterclockwise direction in FIG. 14, moving it into the rest position. The drive member 67 produces counterclockwise rotation of the actuator 269 which lowers the lifting lever 259, positioning the cartridge 246 in the printing position with the typing ribbon 57 in front of the typing point 56. The central unit 98 finally causes de-energisation of the electromagnet 216, block 302, thus positioning the coupling closure element 208 in the inoperative position in which the pawl 211 is disengaged from the teeth of the toothed wheel 66.

It is now possible to operate the keyboard 37 to proceed with typing of the character '1', block 303, in which the central unit 98 activates the motor 72 to rotate the second output member 62 with the character-carrying disc 41, for selecting the character '1' and positioning it in front of the typing point 56, and then produces a print cycle by activating the striker electromagnet 47 to type the character '1', by switching the linear motor 162 into the transport state and activating the motor 72 with 8–12 pulses for the feed movement of the carriage 34 by one step, by means of the transport device 49.

Alternatively to printing a character, it is however possible to proceed with automatic correction of another of the typed characters. In that case, after the block 302, further actuation of the key 294, block 304, causes switching of the linear motor 162 into the transport state, return movement of the carriage 34 by one step and recall from the RAM 101 of the code of the new character. The central unit 98 will return to the phase set out in the block 297, switching the linear motor 162 into the selection state and supplying the motor 72 with a series of pulses such as to position the blade 53 of the new character to be cancelled in the position which is out of phase by 75 steps with respect to the printing position. The subsequent phases will be the same as those described in relation to the blocks 298–303/304.

Figure 24:
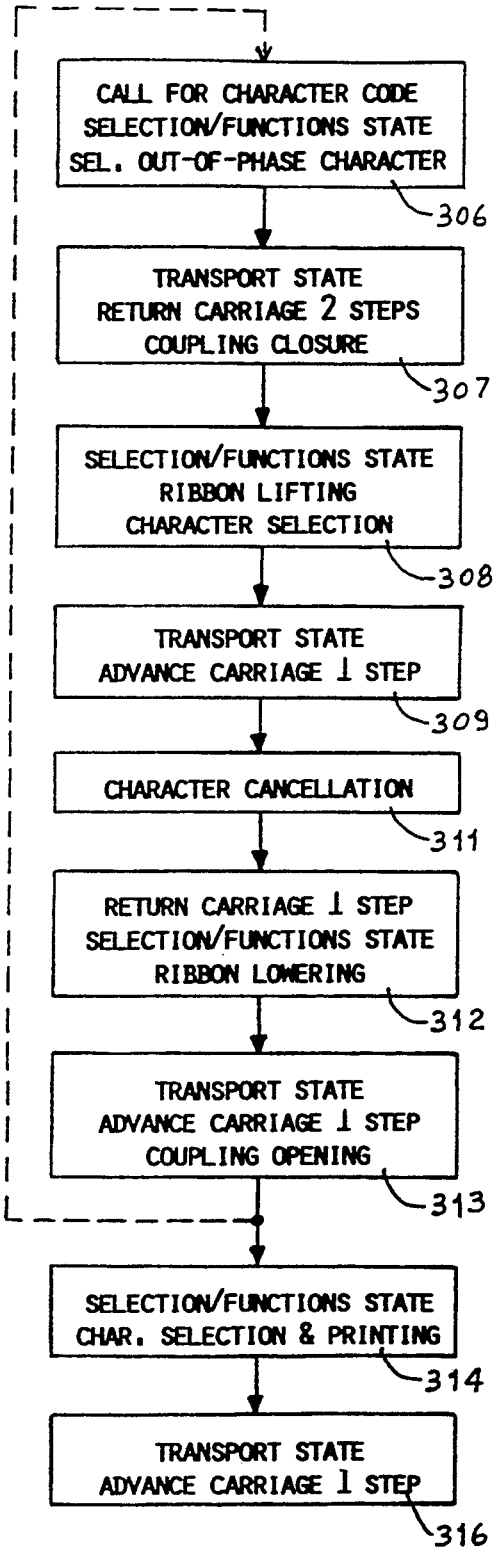
FIG. 24 shows an operating flow chart of the machine in FIG. 1 in a second solution.

When using the second construction, actuation of the key 294 at the keyboard 37 activates the central unit 98 to recall from the RAM 101 the code of the character 'A' to be cancelled, block 306 on FIG. 24. The central unit 98 then causes switching of the linear motor 162 into the selection/functions state, positioning the slide member 178 towards the right-hand plate 174, being the position in which the first output member 61 is locked and the second output member 62 is free to rotate. The central unit 98 now activates the motor 72 with 25 pulses such as to rotate the second output member 62 with the character-carrying disc 41 for a selection cycle in which the character 'A' to be re-struck is angularly out of phase with respect to the typing point 56 by a value (270°) equal and opposite to the angular distance between the sectors 278 and 279.

In the block 307 the central unit 98 causes switching of the linear motor 162 for the transport state, by positioning the slide member 178 towards the left-hand plate 173, whereby the first output member 61 is free to rotate and the second output member 62 is locked. The central unit 98 now activates the motor 72 which rotates the first output member 61 with the pinion 48 and, by means of the rack 36, displaces the carriage 34 in the backward direction. The unit 98 sends in particular 16–24 control pulses, depending on the spacing pitch selected, for a return cycle of two steps, at the end of which the carriage 34 has been displaced in a backward direction by one step with respect to the character 'A' to be re-struck. With the return movement of the carriage 34 by the first step, the friction group 222 rotates with the L-shaped projection 214, freeing the coupling closure element 208 and permitting the spring 212 to position the element 208 in the operative position in which the pawl 211 is accommodated in a space between two teeth of the toothed wheel 66.

The central unit 98 now switches the linear motor 162 into the selection/functions state, block 308, by positioning the slide member 178 towards the right-hand plate 174, and then activates the motor 72 which rotates the second output member 62, the character-carrying disc 41 and the drive member 67. The drive member 67, rotating with the cam 277, by means of the cam follower pin 276 engaging with the decreasing lift from the sector 278 to the sector 279, rotates the actuator 269 in the clockwise direction. The first arm 273 lifts the lifting lever 259 and the latter in turn lifts the cartridge 246 into the correction position with the correction ribbon 58 in front of the typing point 56. At the same time the character-carrying disc 41 rotates angularly and restores the angle by which the character was out of phase, as in block 298. At the end of 75 control pulses the character 'A' to be re-struck is in front of the typing point 56.

In block 309 the central unit 98 switches the linear motor 162 into the transport state, positioning the slide member 178 against the left-hand plate 173, and then activates the motor 72 with 8–12 pulses, in dependence on the pitch, for a cycle of advance movement by one step which moves the carriage 34 with the character 'A' to be re-struck in front of the typing point 56. The central unit 98 now produces a printing cycle, block 311, by actuating the striker electromagnet 47 so as to bring the character 'A' to be struck with the correction ribbon 58 against the roller 31, thus cancelling the character 'A'.

In block 312 the microprocessor 96 produces a cycle involving a return movement of the carriage 34 by one step to permit the coupling closure element 208 to be positioned in the operative position. For that purpose the central unit 98 passes 8–12 pulses to the motor 72. It then switches the linear motor 162 into the selection/functions state, positioning the slide member 178 towards the right-hand plate 174, and then activates the motor 72 to return the drive member 67 to the rest position. The cam 277 produces counterclockwise rotary movement of the actuator 269 which moves the lever 259 downwardly, thus positioning the cartridge 246 in the printing position with the typing ribbon 57 in front of the typing point 56. The central unit 98 now controls the linear motor 162 into the transport state, block 313, by positioning the slide member 178 towards the left-hand plate 173, and thus the motor 72 for an advance cycle of the carriage 34 by one step to move it back into the position in front of the cancelled character 'A'. With the advance movement of one step, the L-shaped projection 214 is re-engaged with the limb 213 and positions the coupling closure element 208 in the inoperative position.

From the keyboard 37, it is now possible to proceed with typing of the character '1', block 314. The central unit 98 switches the linear motor 162 into the selection/functions state, positioning the slide member 178 towards the right-hand plate 74, and by means of the motor 72 rotates the second output member 62 with the character-carrying disc to select the character '1' and position it in front of the typing point 56. The central unit 96 actuates a printing cycle by means of the striker electromagnet 47, and prints the character '1'. Finally the unit 98 switches the linear motor 162 into the transport state, block 316, and activates the motor 72 with the transport device 49 for advancing the carriage 34 by one step.

In the event that the operator should want to correct another of the characters typed, further actuation of the key 294 after the block 313 would cause return to the block 306 for recall of the code of the new character to be corrected, switching of the linear motor 162 into the functions state, and subsequent selection of the out-of-phase character. The subsequent phases will be the same as those described in relation to the blocks 306–316.

LINE SPACING DEVICE I

Figure 15:
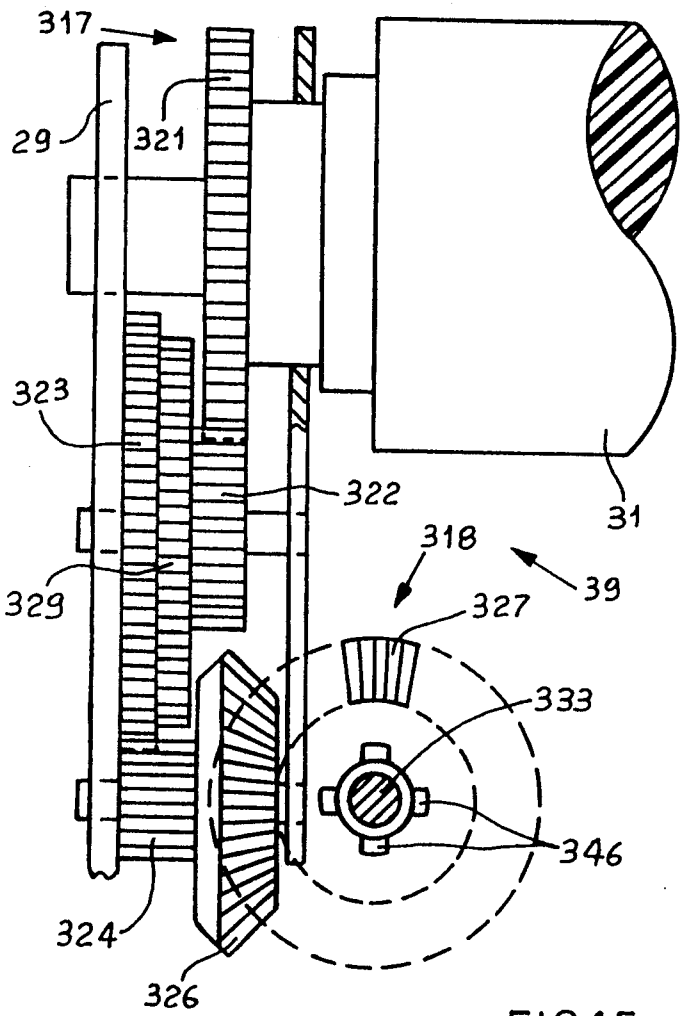
FIG. 15 shows a partly sectional front view of some details of the machine shown in FIG. 1.
Figure 16:
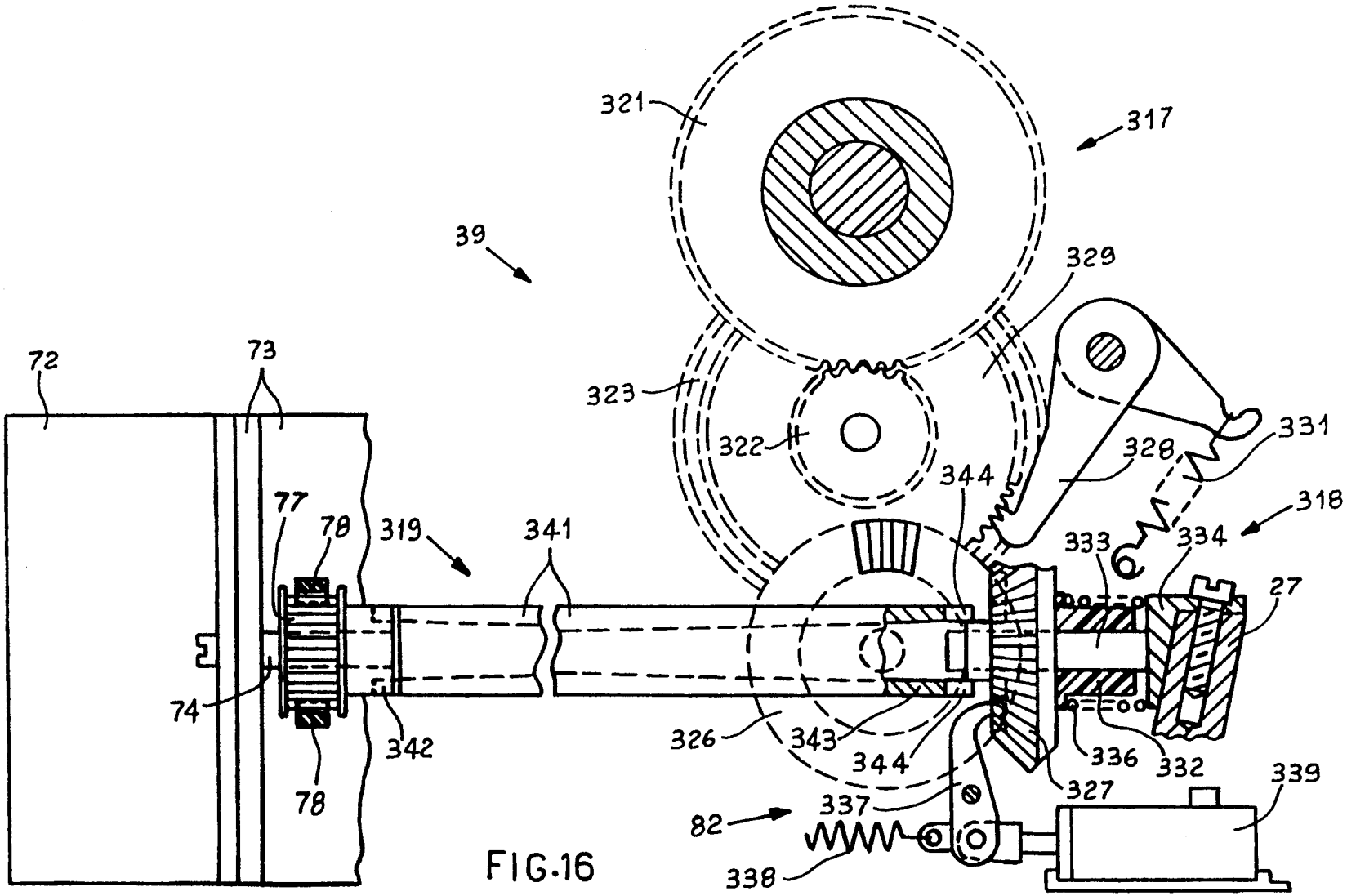
FIG. 16 shows a longitudinal view of part of the details from FIG. 15.

With reference to FIGS. 1, 2, 8, 10 and 12, and particularly to FIGS. 15 and 16, the line spacing device 39 comprises an execution mechanism 317 supported by the side portion 29 of the frame structure 27, an actuating mechanism 318 supported by the frame structure 27 and connected to the execution mechanism 317, and connecting means 319 interposed between the motor 72 and the actuating mechanism 318.

The execution mechanism 317 comprises a series of gears having a toothed wheel 321 which is fixed with respect to the platen roller 31 and which is always engaged with a first pinion 322 which is fixed with respect to a second toothed wheel 323 which in turn is always engaged with a second pinion 324 which is fixed with respect to a bevel gear 326. The bevel gear 326 is capable of being engaged by a bevel gear 327 of the actuating mechanism 318. A toothed positioning device 328 engages, under the force of a spring 331, with a toothed wheel 329 which is fixed with respect to the first pinion 322 and with the second toothed wheel 323 to hold the roller 31 in the position that it has reached.

The actuating mechanism 318 is of the coupling type having a tube member 332 rotatable on a pin 333 fixed on a support 334 of the frame structure 27 and fixed with respect to the bevel gear 327. A coil spring 336 which is guided by the tube member 332 and positioned between the bevel gear 327 and the support 334 urges the tube member 332 with the bevel gear 327 towards an operative position in which the gear 327 is in engagement with the gear 326. The tube member 332 can be held in an inoperative position by the electromagnetically actuated clutch means 82 operative as stop means and which comprise a coupling control lever 337 and a spring 338. The action of the spring 338 predominates over that of the spring 336 on the tube member 332 whereby the lever 337 holds the tube member 332 in the inoperative position.

A line spacing electromagnet 339 is connected to the control lever 337 and can be energised under the control of the microprocessor 96 to displace the lever 337 against the force of the spring 338 towards a coupling position in which it permits the spring 336 to displace the tube member 332 into the operative condition such as to bring the bevel gear 327 into engagement with the bevel gear 326.

The connecting means 319 comprise a transmission shaft 341 which has a first end 342 connected to the pulley 77 and a second end 343 supported rotatably by the pin 333 and provided with teeth 344 arranged to engage teeth 346 of the tube member 332 when the tube member 332 is in its operative position.

For operation of the line spacing device 39, in the event that the machine 26 uses the construction with the switching control means 68 provided with the electromagnet 216, the microprocessor 96 actuates a carriage return cycle for the carriage 34, which involves passing a series of switching pulses to the motor 72 to move the carriage 34 in a backward direction to the beginning of the line of printing. The microprocessor 96 then switches the linear motor 162 into the selection/functions state and energises the line spacing electromagnet 339, bringing the bevel gear 327 into engagement with the bevel gear 326. Finally the microprocessor 96 activates the motor 72 to rotate the roller 31 by a number of line spacing microsteps corresponding to the line spacing set at the keyboard 37.

In the event that the machine uses the construction with the switching control means 69 and the friction group 222, for effecting a carriage return cycle, the microprocessor 96 provides for stopping the carriage 34 at a position outside its usual travel, being one step beyond the 'new line' position at the beginning of a line. Subsequently the microprocessor 96 causes the carriage to perform a step in a forward direction in such a way that the carriage 34 is positioned at the position at the beginning of the line, causing return to the inoperative position of the coupling closure element 208 which was actuated in consequence of the return of the carriage 34 to the beginning of the line. The microprocessor 96 then proceeds to switch the motor 162 into the selection/-functions state and effects activation of the electromagnet 339 and the motor 72, as in the previous case.

In both the constructions of the switching control means 68 and 69, rotary movement of the roller 31 is associated with a simultaneous rotary movement of the character-carrying element 41, which is not linked to the desired selection of a particular character. The angular position of the element 41 is stored in the RAM 101 and the central unit 98 takes account of that new position when it is to proceed with a subsequent cycle of selecting characters 54. At the end of a line spacing cycle, the microprocessor 96 also proceeds to switch the linear motor 162 into the reference transport state for the machine 26.

LINE SPACING DEVICE II

When the machine 26 adopts the alternative configuration with a motor 87 (FIG. 17) mounted on the carriage 34, the line spacing device 39 (FIGS. 1, 2, 8, 9, 10, 13, 17, 18, 19, 20, 21, 22, 23 and 24) comprises the line spacing execution mechanism 89 supported by the left-hand side portion 29 of the frame structure 27, the actuating mechanism 88 supported by the carriage 34 and a line spacing profile member 347 projecting axially from the plane of the drive member 67. The connecting means between the actuating mechanism 88 and the line spacing execution mechanism 89 comprise the splined bar 32 for transmitting the motion from the actuating mechanism 88 to the line spacing execution mechanism 89 in any position of the carriage 34 along the line of typing.

The line spacing execution mechanism 89 comprises an input lever 348 fixed to the splined bar 32, rotatably supported on the side portions 28 and 29, and having an arm 349 with a seat 351 for accommodating a pin 352 on a pull member 353. A spring 354 disposed between a shoulder 356 of the pull member 353 and a cup-like member 357 which is slidable on the pin 352 holds the cup-like member 357 against the arm 349 of the input lever 348. The pull member 353 is connected by means of a pin 358 to a bell crank lever 359 pivotally mounted on a pin 361 on the side portion 29. The bell crank lever 359, by means of a pin 362, supports a pawl 363 co-operable with the teeth of a toothed wheel 364 which is fixed with respect to the platen roller 31.

The bell crank lever 359 is connected by means of a spring 366 to the input lever 348. A spring 367 disposed between the bell crank lever 359 and the pawl 363 holds the latter engaged with a limb 368 against a fixed cam 369 of the left-hand side portion 29 which is capable of guiding the pawl 363 when a line spacing cycle is actuated for engaging the teeth of the toothed wheel 364. A travel regulator 371 which is only diagrammatically illustrated is supported by the side portion 29 and is positioned to co-operate with the pawl 363 to stop the travel movement thereof after a predetermined distance in such a way that the roller 31 is always rotated by a constant amount.

As the input lever 348 is always positioned by the same travel movement for actuating the pawl 363, the spring 354, besides transmitting the movement to the pawl member 353, also acts as a resilient connection and, by being compressed, absorbs and nullifies the excess travel motion of the input lever 348. That also avoids serious disadvantages which could arise if for example the roller 31 were locked due to unforseeable causes and a line spacing cycle were actuated at the same time.

The line spacing actuating mechanism 88 comprises a finger lever 372 which oscillates with the splined bar 32 and an L-shaped lever 373 (FIGS. 17 and 21) which is pivotally mounted on a pin 374 on the carriage 34. The lever 372 is coupled in an angularly fixed and essentially slidable fashion to the splined bar 32 and is connected to the side portion 107 of the carriage 34 by means of a coupling element 376 (FIG. 19). The lever 372 is connected to the L-shaped lever 373 by means of a slot 377 for receiving a spherical end 378 of the L-shaped lever 373. The L-shaped lever 373 is pivotally mounted on the pin 374 by means of a slot 379 which permits the L-shaped lever 373 to be displaced in a perpendicular plane and comprises a cam follower pin 381 co-operable selectively with the line spacing control profile member 347.

The change mechanism 93 (FIGS. 18, 21 and 22) which is responsive to the direction of movement of the drive member 67 comprises a line spacing exclusion profile member 382 which is formed by the upper edge of the line spacing control member 347 and a spring 383 disposed between the L-shaped lever 373 and the carriage 34. The spring 383 holds the L-shaped lever 373 locked with the bottom of the slot 379 against the cylindrical pin 374 and with the cam follower pin 381 bearing against the line spacing control profile 347. In the case where the drive member 67 rotates in the counter-clockwise direction in relation to FIG. 18 from the rest position, the pin 381 is capable of following the side of the profile member 347 and displaces the L-shaped lever 373 angularly in a clockwise direction for rotary movement of the bar 32. If however the drive member 67 rotates in the clockwise direction the pin 381 is capable of engaging an inclined surface 384 (see also FIG. 20) of the line spacing control member 347 and subsequently the line spacing exclusion member 382 to displace the L-shaped lever 373 in a plane perpendicular to the drive member 67. That displacement is permitted by the magnitude of the slot 379 with respect to the pin 374. Subsequently due to the force of the spring 383 the pin 381 follows a rib portion 386 with a constant lift, keeping the angular positions of the lever 373 and the bar 32 unchanged.

The mechanism 93 finally comprises an alternative form as regards the support for the actuator 269 and the correction cam 277 having a correction exclusion profile member 387. In particular the actuator 269 is pivotally connected to pins 271 and 272 in corresponding slots 388 and 389 of the transverse supports 109 and 111 respectively and which permit the actuator 269 to oscillate with respect to its axis. A spring 391 holds the actuator 269 in an arrested condition with the pins 271 and 272 against the bottoms of the respective slots 388 and 389 and urges the cam follower pin 276 outwardly and against the inside of the side portion 392 of the correction cam 277. The correction cam 277 has the open sector 278, and the correction exclusion profile member 387 is connected to the outward side of the correction cam 277 and an inclined surface 393 is connected to the outward side of the correction cam 277 which is positioned adjacent to the sector 278. The inclined surface 393 is connected to the outward side which defines the cam 277 at a position corresponding to the sector 279. In that way when the drive member 67 rotates in a counterclockwise direction for a line spacing cycle the inclined surface 393 causes the cam follower pin 276 to bear against the inward edge of the line spacing exclusion profile member 387 and thus follow the inward side 392 with a constant lift, holding the cartridge 246 in the typing position.

The mode of operation of the line spacing device 39 in the low-cost configuration thereof is as follows:

The central unit 98 which receives from the keyboard 37 the code for activating the line spacing 39 activates the motor 87 with a series of switching pulses such as to move the carriage 34 to a position beyond its usual travel, one step beyond the position at the beginning of the line. The consequence of that, as already described hereinbefore, is activation of the motion switching mechanism 64 which, by means of the friction group 222, positions the pawl 211 in the operative position, connecting the drive member 67 to the second output member 62 in respect of rotary movement. The microprocessor 96 now switches the linear motor 162 into the selection/functions state in which the second output member 62 of the transmission unit 52 is free to rotate and supplies the motor 87 with control pulses in sequence such as to rotate the second output member 62 with the drive member 67 in the counterclockwise direction in FIG. 18.

As soon as the drive member 67 begins to rotate in the counterclockwise direction, the line spacing control profile member 347 engages the cam follower pin 381 and rotates the L-shaped lever 373 in a clockwise direction in a plane parallel to the drive member 67. The L-shaped lever 373 causes rotation in a counterclockwise direction of the finger lever 372 with the splined bar 32. The splined bar 32 causes rotary movement in a counterclockwise direction of the input lever 348 which, with the arm 349, causes sliding movement of the cup-like member 357, thus compressing the spring 354. The spring 354 lifts the pawl member 363 which in turn causes rotation in a counterclockwise direction of the bell crank lever 359 whereby the spring 367 causes the limb 368 to slide against the fixed cam 369 to move the pawl 363 towards the teeth of the wheel 364 until it is engaged into a space between the teeth of the toothed wheel 364, causing it to rotate in the clockwise direction with the roller 31. After a rotary movement of the drive member 67 through 360°, corresponding to one hundred control pulses at the motor 87, the L-shaped lever 373 is again in its rest position and the springs 354, 366 and 367 return the execution mechanism 89 to the rest condition.

Figure 22:
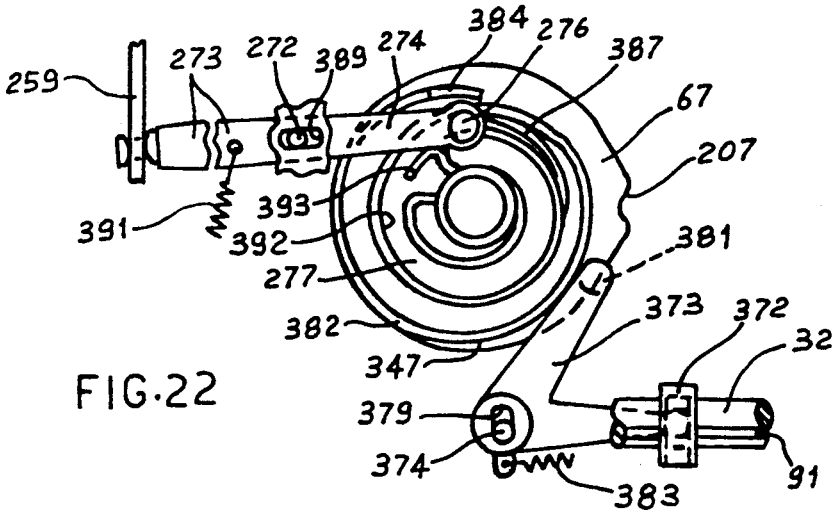
FIG. 22 shows a front view of the details from FIG. 18, in another working position, on a different scale.

That line spacing cycle has no effect on the position of the cartridge 246 since due to the effect of the rotary movement in a counterclockwise direction of the drive member 67 which is visible in FIG. 22, the cam follower pin 276 is engaged with the inclined surface 393 whereby it is displaced with the actuator 269 along the slots 388 and 389 against the force of the spring 391 until engaging the exlusion correction member 387 and subsequently the internal surface 392. After a rotary movement of about 270° under the force of the spring 391 the pin 276 jumps back to the plane of the sector 278.

Actuation of the line spacing device 39 rotates the roller 31 by a line spacing micro-step for a cycle. The central unit 98 therefore activates as many operative cycles of the drive member 67 by repeatedly actuating the line spacing device 39, to correspond to the line spacing control codes which are received from the keyboard 37. At the end of execution of the line spacing cycle the microprocessor 96 switches the linear motor 162 into the transport state and advances the carriage 34 by one step, moving it to the beginning of the line, and by means of the friction group 222 positions the pawl 211 in the inoperative position.

If however the central unit 98 receives from the keyboard 37 the code for actuating the correction device 46 the microprocessor 96 proceeds with execution of the phases described in the blocks 306 and 307. When it proceeds to execute the operation set forth in the block 308, the drive motor 67 which rotates in the clockwise direction in FIG. 18 performs the correction cycle in the manner already described above. The cam follower pin 381 however is engaged with the inclined surface 384 and the line spacing exclusion member 382 and is displaced with the L-shaped lever 373 in a plane perpendicular to the reference plane of the drive member 67. That displacement is permitted by the magnitude of the slot 379 with respect to the cylindrical pin 374. The cam follower pin 381 is held engaged with the line spacing exclusion member 382 and with the inward side of the constant-lift rib portion 386, due to the force of the spring 383. In that position the L-shaped lever 373 holds the finger lever 372 in the rest position and therefore cannot actuate the execution mechanism 89 of the line spacing device 39. After the rotary movement through 270° in the clockwise and counterclockwise directions of the drive member 67, which is prescribed by the correction cycle, the L-shaped lever 373 returns to its rest position due to the force of the associated spring 383 and can thus be actuated for a subsequent correction cycle or a fresh line spacing cycle.

TYPING RIBBON FEED DEVICE

Figure 13:
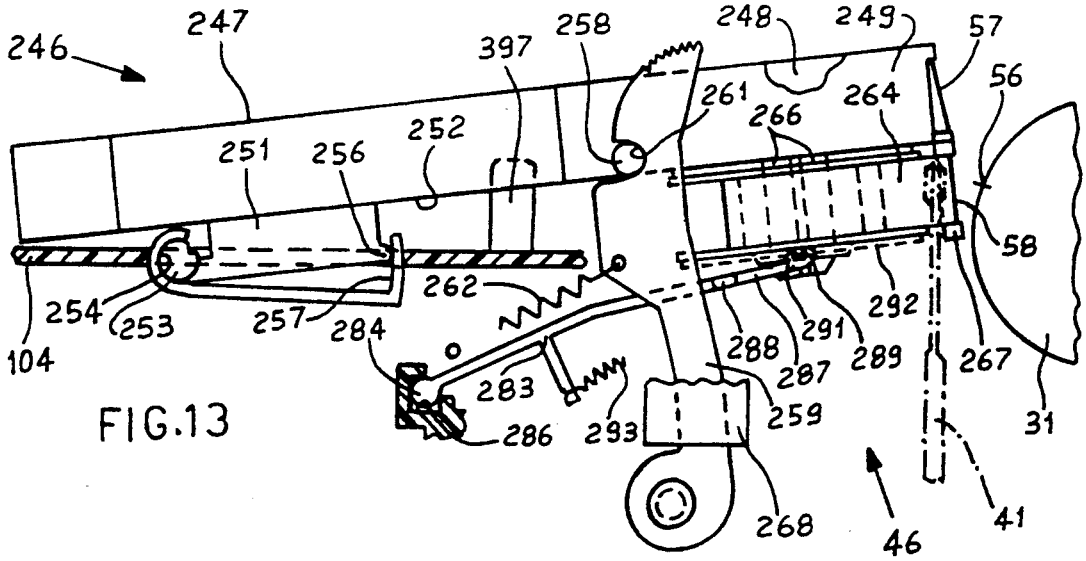
FIG. 13 is a longitudinal view on a different scale of part of the machine showing some details from FIG. 3 in a working position.
Figure 21:
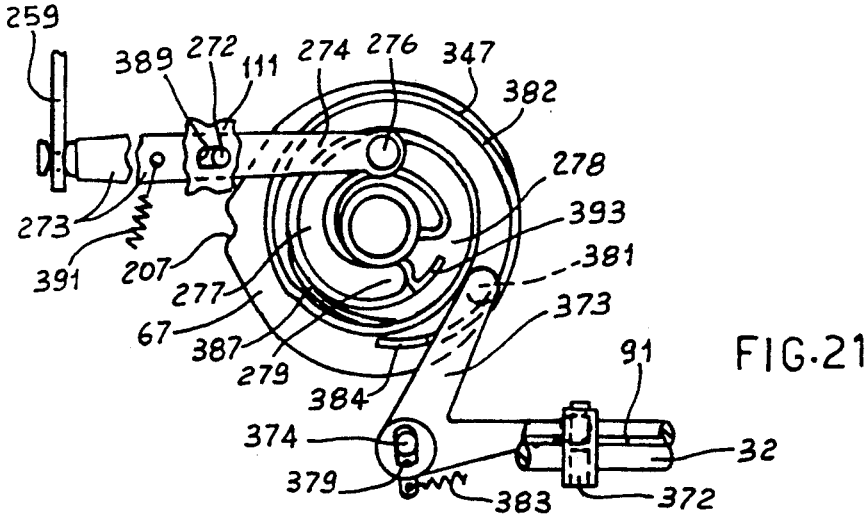
FIG. 21 shows a front view of the details in FIG. 18, in a working position, on a different scale.

The typing ribbon feed device 44 (FIGS. 1, 2, 3, 4, 5, 8 and 13) comprises a connecting mechanism 396 (FIG. 4) interposed between the movable slider 146, actuated by the slide member 178 of the linear motor 162 (FIG. 8), and an element 397 for the feed movement of the ribbon, for transforming the rectilinear alternating movement of the movable slider 146 into a unidirectional movement for advancing the typing ribbon 57 which is accommodated in the cartridge 246 (FIG. 13).

The connecting mechanism 396 is formed by a lever which is rotatable on a pin 398 on the carriage 34 and connected at one end by means of a connection comprising a pin 399 and a slot 401 on the movable slider 146. Another end of the lever 396 carries a shaft 402 on which two ratchet members 403 and 404 are rotatable. The ratchet members 403 and 404 have two pawls 406 and 407 co-operable with a sawtooth wheel 408 which in turn is connected to the element 397 for the feed movement of the ribbon. For that purpose a resilient element 409 holds the two pawls 406 and 407 constantly in engagement with first and second teeth of the toothed wheel 408, which are disposed on mutually diametrally opposite parts.

The two pawls 406 and 407 are positioned with their respective active parts in opposite directions to each other in such a way that during actuation in one direction of the slide member 178, for example from left to right, the first pawl 406 pushes the first tooth of the toothed wheel 408 and rotates the wheel 408 through an angular step while at the same time the second pawl 407 passes over the second tooth. During the rectilinear movement of the slide member 178 in the opposite direction, the second pawl 407 entrains the second tooth and rotates the wheel 408 through another angular step in the same direction as that produced previously while the first pawl 406 passes over the tooth adjacent to the first tooth. That causes the typing ribbon 57 to be advanced with a unidirection movement during the alternating rectilinear movement of the slide member 178 and the movable slider 146.

The ribbon feed element 397 is formed by a blade member which is fixed with respect to the toothed wheel 408, capable of engaging with a feed roller which is accommodated in the cartridge 246, being known per se and not shown in the drawings, for producing the feed movement of the typing ribbon 57. The blade 397 is of a sufficient length always to remain engaged with the ribbon feed roller both when the cartridge 246 is in the printing position and when the cartridge 246 is in the correction position shown in FIG. 13.

ZERO SETTING DEVICE

The electronic typewriter 26 (see FIGS. 1, 2, 3, 4, 8, 11, 14 and 18) can be connected to be powered by the normal mains supply and rechargeable batteries as diagrammatically shown and indicated at 411 which can be periodically recharged from a normal supply device 412 which in turn can be connected to the mains power.

The electronic typewriter 26 comprises a zero setting device 413 (FIG. 11) which can be actuated under the control of the ROM 99 and the central unit 98 each time that the electronic typewriter 26 is turned on by a switch 414, for positioning a reference character on the character-carrying disc 41 in front of a typing point 56 at the beginning of the line of printing. The zero setting device 413 also provides for initialising the RAM 101 in such a way that the content of the locations associated with the angular position of the element 41 and the position of the carriage 34 along the line of printing respectively are unambiguously associated with the above-mentioned positions.

The zero setting device comprises initialisation routines in the ROM 99, the end-of-travel stop 282 of the cam 277 on the drive member 67, a substantially vertical lever 416 (FIGS. 3, 4 and 11) which is pivoted on a pin 417 on the carriage 34 and a counteracting element 418 in the form of a slider guided slidably by guides 419 on the carriage 34, parallel to the roller 31. At a free end the lever 416 has a tooth 421 co-operable with an external cylindrical surface 422 and with a space 423 of the support flange 203 on which the character-carrying disc element 41 is fixed in a predetermined and preset position. The element 418 in turn comprises a projection 424 co-operable with a shoulder 426 on the lever 416 and an end 427 projecting from the side portion 106 of the carriage 34. The initialisation routines in the ROM 99 activate the motors 72, 87 and the linear motor 162 and, if it is used, the electromagnet 216, to put the drive element 67 into a zero condition, the carriage 34 in the position outside its usual travel at the beginning of the line and the character-carrying element 41 in an angular reference position.

A coil spring 428 which is disposed between the lever 416 and another end of the element 418, around the pin 417, holds the projection 424 in a position of being arrested against the shoulder 426 and, by virtue of the different lengths of the operating arms, normally holds the lever 416 rotated in a clockwise direction, arrested against a fixed pin 429 on the carriage 34 and with the tooth 421 disposed away from the surface 422. The element 418, with its projecting end 427, can co-operate with a shoulder 27 on the right-hand side portion 28 of the frame structure 27 when the carriage 34 is in a position outside its usual travel, at the end of the line of printing.

The zero setting device 413 is activated by the microprocessor 96 whenever the electronic typewriter 26 is switched on, and its mode of operation is as follows. The microprocessor 96 first activates the linear motor 162 to put it in the transport state and supplies the motors 72, 87 with four control pulses for return movement of the carriage 34 by one step and activation of the switching mechanism 64. It then proceeds to switch the linear motor 162 for the selection/functions state in such a way as to connect the drive shaft 51 with the drive member 67 in respect of rotary movement.

The central unit 98 then activates the motor 72, 87 with around 100 low-frequency and low-energy control pulses for a rotary movement of the drive member 67 in the counterclockwise direction in FIGS. 14 or 18, in such a way as move the member 67 into the position in which the end-of-travel stop 282 of the cam 277 is arrested by the cam follower pin 276, independently of the initial position of the member 67. The microprocessor 96 then proceeds to activate the motors 72, 87 with around 30 control pulses for rotary movement in the clockwise direction of the member 67 such as to cause the seat 207 to engage the resilient blade 206, corresponding to the rest position of the member 67.

The microprocessor 96 then proceeds to switch the linear motor 162 into the transport state and activates the motor 72, 87 with a series of low-frequency and low-energy pulses in a number which is greater than double the elementary steps contained in a line of printing. The sequence is such as to rotate the transport member 48 and move the carriage 34 to the final position outside its normal travel, adjacent to the right-hand side portion 28, independently of the initial position. The central unit 98 then loads the location of the RAM 100 intended for the position of the carriage 34 with the number corresponding to the carriage position outside its normal travel.

Figure 11:
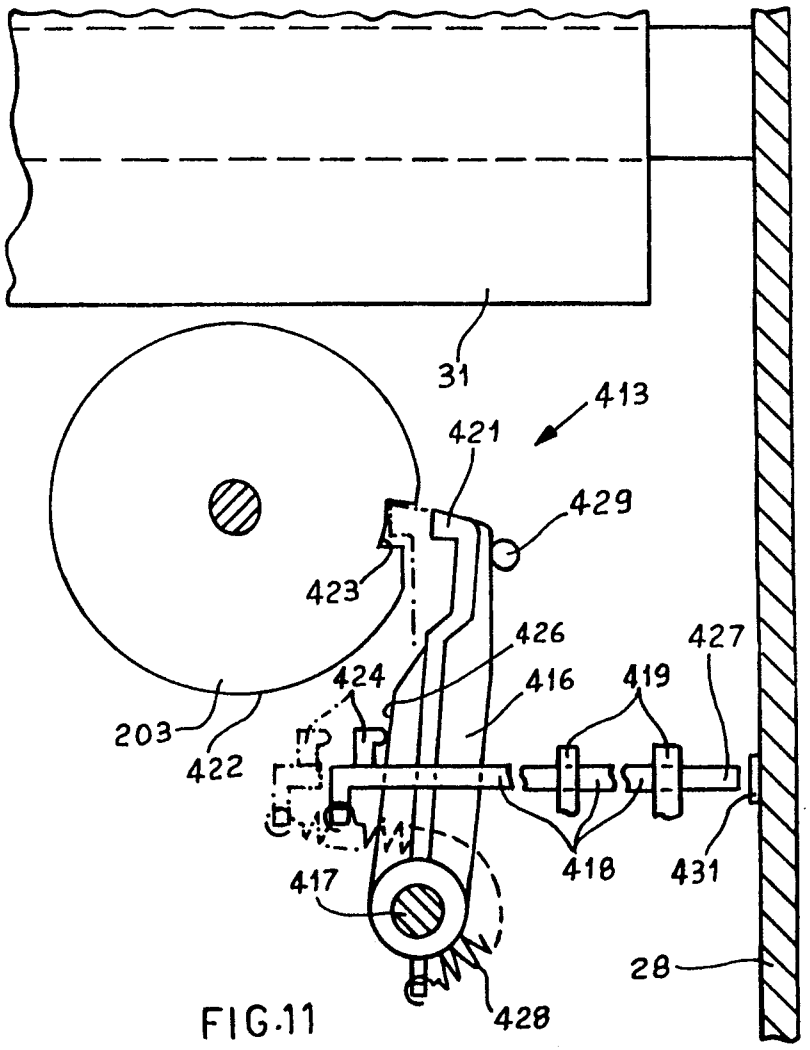
FIG. 11 is a front view of part of the machine showing some details from FIG. 4.

In the position of the carriage outside its normal travel, the projecting end 427 of the element 418 is engaged with the shoulder 431 and is therefore urged inwardly of the carriage 34, as shown in dash-dotted line in FIG. 11. The element 418, by means of the spring 428, causes counterclockwise rotary movement of the lever 416, thus moving the tooth 421 into position against the external circular surface 422 of the support flange 203 and holding it in that position. The central unit 98 now switches the linear motor 162 into the selection/functions state and activates the motor 72, 87 with one hundred low-frequency and low-energy control pulses for a selection cycle in the clockwise direction of the second output member 62 and the support flange 203 such as to rotate the character-carrying disc 41 until the tooth 421 securely engages the space 423 under the effect of the force of the spring 428. As it engages into the space 423, the tooth 421 stops the rotary movement and that angular position attained determines the exact position of the predetermined character of the character-carrying disc 41 in front of the typing point 56. The central unit 98 then zeroes the location in the RAM 100 intended for the position of the character-carrying element 41 and switches the linear motor 162 into the transport state; it again activates the motor 72, 87 for moving the carriage 34, positioning it in the position at the beginning of the line adjacent to the left-hand side portion 29. As soon as the carriage 34 begins to move, the element 418 is disengaged from the shoulder 431 and the spring 428 returns the lever 416 to its original position, with the tooth 421 away from the space 423. When using the friction group 222, the microprocessor 96 stops the carriage 34 beyond its normal travel by a spacing step beyond the 'new line' position at the beginning of a line and then produces a spacing step in a forward direction in such a way as to position the carriage 34 at the beginning of the line, causing the coupling closure element 208 to return to the inoperative position.

It will be appreciated that various modifications and improvements both in respect of the form and the arrangement of the various parts may be made in the electronic typewriter, the various arrangements and mechanisms and the sequence of the modes of operation thereof as described hereinbefore, without thereby departing from the scope of the present invention.

What we claim is:

1. An electronic typewriter comprising:

a platen roller;

a carriage which is displaceable along the roller and on which are mounted a drive shaft, a rotatable character-carrying element, a transport member for displacement of the carriage, a selector shaft for selectively rotating the character-carrying element and selecting the characters to be typed, one or more function devices for performing one or more functions associated with typing of characters, a motion transmission unit having an input member connected in respect of rotary movement to the drive shaft and a first output member connected to the transport member, and transmission control means actuable into a transport state for connecting the drive shaft in respect of rotary movement to said first output member;

an electric actuating motor for rotating said drive shaft;

an electronic controlling arrangement for controlling said motor and said transmission control means;

a motion switching mechanism having an input member connected in respect of rotary movement to a second output member of said transmission unit; and switching control means which are actuable in an operative state under the control of the electronic controlling arrangement for connecting the second output member in respect of rotary movement to said function devices for actuation thereof;

wherein the transmission control means are actuable by the electronic controlling arrangement in a selection/functions state for connecting the drive shaft in respect of rotary movement to the second output member and wherein the electronic controlling arrangement comprises means for controlling said actuating motor, causing bidirectional and selective rotary movements of the drive shaft for displacement of the carriage, for selection of the characters and for performing function cycles of the function device or devices.

2. A typewriter according to claim 1, in which said transmission unit comprises a differential mechanism and wherein said transmission control means comprise electromagnetic means which are actuable in the transport state and in the selection/functions state and a first and a second stop member which are operatively connected to said electromagnetic means and wherein in the transport state the second stop member is capable of locking the second output member to transmit the motion from the drive shaft to the first output member and in the selection state the first stop member is capable of locking the first output member to transmit the motion from the drive shaft to the second output member.

3. A typewriter according to claim 1, in which said motion switching mechanism comprises a coupling having a drive portion connected for rotary movement to the second output member, a driven portion connected for rotary movement to said function device or devices and a coupling closure element mounted on said driven portion and displaceable from an inoperative position to an operative position for connecting said drive portion and said driven portion together in respect of rotary movement, wherein said driven portion constitutes a drive member for said function device or devices and wherein said closure element is co-operable with said switching control means to actuate a cycle of rotation of said driven portion.

4. A typewriter according to claim 3, in which the electronic controlling arrangement controls said switching control means by means of a corresponding electromagnet.

5. A typewriter according to claim 3, in which said switching control means are actuated by an actuating mechanism connected to the first output member and wherein the electronic controlling arrangement activates said actuating mechanism, causing a cycle involving return of the carriage by one step along said printing line.

6. A typewriter according to claim 1, in which said function device or devices comprise first cam means which are connected in respect of rotary movement to a drive member which is set in rotation, and which are capable of rotating from an inoperative position to an operative position, and first cam follower means which co-operate with said first cam means to predispose said function device or devices in an actuated state in response to the rotary movement of said cam means from the inoperative position to the operative position.

7. A typewriter according to claim 6, in which said first cam follower means actuate a first function device and that there are further provided second cam means connected to said drive member in respect of rotary movement, second cam follower means co-operating with said second cam means to actuate a second function device, and means responsive to the direction of rotation of the drive member to actuate the second or the first function device, wherein the means responsive to the direction of rotation comprise a first and a second exclusion shaped member which are connected to said drive member in respect of rotary movement and wherein the first exclusion shaped member is provided to exclude the first cam follower means from co-operation with the first cam means in response to a first direction of movement of said drive member and the second exclusion shaped member is provided to exclude the second cam follower means from co-operation with the second cam means in response to a second direction of movement of said drive member, which is opposite to said first direction of movement.

8. A typewriter according to claim 6, in which said function device or devices comprise a correction device for correcting characters which are already typed, having a correction ribbon which can be interposed in front of the typing point for correction by means of re-striking of the typed characters and guide means for guiding a portion of the correction ribbon between the character-carrying element and the roller, wherein:

said guide means are connected to the first cam follower means to be displaced from an inoperative position to an operative position in response to the rotary movement of said first cam means from the inoperative position to the operative position;

the rotary movement of the first cam means from the inoperative position to the operative position is associated with a rotary movement of the character-carrying element in a given direction of movement, included in a preset out-of-phase value; and wherein the electronic controlling arrangement controls the correction device for a correction cycle in respect of the typed character to be corrected, by way of sequential control means comprising:

first means for actuating the transmission control means in the selection/functions state for the transmission of the motion from the drive shaft to the second output member and for activating the motor in such a way as first to rotate the second output member by an amount such that on the character-carrying element the character to be re-struck is angularly displaced with respect to the typing point by a distance equal and opposite to said out-of-phase value;

second means for actuating the motion switching mechanism in such a way as to connect said drive member together to said second output member and for actuating the drive shaft a second time in such a way as to rotate said cam means from the inoperative position to said operative position and such that the character-carrying element is rotated by said out-of-phase value such as to bring the correction ribbon and the character to be re-struck in front of the typing point; and third means for activating said motor a third time after re-striking of the character to be corrected in such a way as to move the cam means into the inoperative position and de-activate the motion switching mechanism.

9. A typewriter according to claim 8, further comprising a cartridge for a typing ribbon which is pivotally mounted on said carriage to position a portion of the typing ribbon in front of a typing point on the platen roller, and the guide means for positioning the correction ribbon below the typing ribbon is carried by the cartridge, wherein the cam follower means comprise an actuating lever having a portion co-operable with said cam means and another portion capable of causing said cartridge to oscillate, wherein the cam means are provided for moving the cartridge from a first position in which said guide means are in the inoperative position and the typing ribbon is in front of the typing point to a second position in which said guide means are in the operative position and the correction ribbon is in front of the typing point and vice-versa.

10. A typewriter according to claim 1, in which the actuating motor has a stator mounted on a fixed support, the drive shaft is connected in respect of rotary movement to a pinion rotatable on the carriage, and wherein there is provided a toothed belt which is supported in such a way as to have a run thereof which extends along the printing line to transmit the motion from a rotor of the actuating motor to said drive shaft by means of said pinion.

11. A typewriter according to claim 1, comprising a line spacing mechanism for rotating said roller, and in which said actuating motor is mounted on a frame structure of the machine and wherein there are provided connecting means between said motor and said drive shaft for rotating said drive shaft in any position of the carriage along the printing line and a line spacing coupling which is controlled by said electronic controlling arrangement for actuating said line spacing device by means of said motor.

12. A typewriter according to claim 1, in which the actuating motor is mounted on the carriage and said function device or devices comprise a line spacing device having a line spacing execution mechanism for rotating the roller supported by a frame structure for supporting said roller, a line spacing actuator supported by the carriage and positioned under the control of said second output member and connecting means between the line spacing actuator and the line spacing execution mechanism for transmitting the motion from the line spacing actuator to the line spacing device in any position of the carriage along the printing line.

13. A typewriter according to claim 1, in which said transmission control means comprise electromagnetic means having a control element which is displaceable into one of two positions which are respectively associated with the selection/functions state and the transport state and wherein said machine further comprises a feed device for feeding a portion of the typing ribbon in anticipation of printing of another character and connecting means between said transmission control means and said feed device for driving said ribbon feed device in response to any switching of said transmission control means between the selection/functions state and the transport state.

14. A typewriter according to claim 1, in which said electronic controlling arrangement comprises:

first control means for actuating the transmission control means into the transport state and for activating the actuating motor for bidirectional rotary movement of the drive shaft, associated with a bidirectional displacement of the carriage along the printing line;

second control means for actuating the transmission control means into the selection/function state and for activating said motor for a variable and bidirectional rotary movement associated with a corresponding bidirectional rotary movement of the character-carrying element such as to move a character to be typed from a variable position with respect to the typing point to a selection position in front of said typing point; and third control means for actuating the transmission control means into the selection/functions state and the switching control means into the operative state and for activating the motor for a rotary movement associated with a function cycle of said function device or devices.

15. A typewriter according to claim 1, in which the actuating motor is of the stepping type and the electronic controlling arrangement controls said motor for a number of steps of the drive shaft which is different for the selection/functions state or for the transport state.

16. An electronic typewriter comprising:

a platen roller;

a carriage movable along a printing line parallel to the roller and on which are mounted a drive shaft, a rotatable character-carrying element, a transport member for movement of the carriage and a selector shaft for selectively rotating the character-carrying element and selecting the characters to be typed;

an electric actuating motor for rotating said drive shaft;

an electronic controlling arrangement which is actuable to control the actuating motor, the transport member and the selector shaft;

defferential motion transmission unit having an input member, a first output member and a second output member, wherein said input member is driven by said motor, the first output member drives the transport member and the second output member drives the selector shaft;

first and second stop members which are each displaceable from a rest position to an operative position to lock the first and the second output members respectively; and electromagnetic means which are actuable under the control of said electronic controlling arrangement for displacing the second stop member or the first stop member into the operative position so that the motion of the drive shaft is transmitted to the first output member or the second output member respectively.

17. A typewriter according to claim 16, in which said input member comprises a drive pinion which is synchronous with the drive shaft in respect of rotary movement, said first output member comprises a support which is rotatable coaxially with said pinion and on which are rotatably mounted planet gears which in turn are engaged with said drive pinion, and said second output member comprises a gear rotatable coaxially with said pinion and having an internal tooth configuration which in turn meshes with said planet gears.

18. A typewriter according to claim 16, in which said electromagnetic means comprise a double-acting linear motor for simultaneously positioning the first and second stop members in the operative position and in the rest position and conversely in the rest position and in the operative position.

19. A typewriter according to claim 17, in which said support and said gear each comprise a toothed ring wherein the first and second stop members carry respectively first and second pawls and wherein the first and second pawls are capable of engaging the toothed ring of said support and the toothed ring of said gear respectively, for locking said support and said gear respectively.

20. A typewriter according to claim 16, further comprising a rack positioned parallel to the roller and having the ends fixed to the frame structure, and in which said transport member comprises a pinion engaged with said rack and supported rotatably on the carriage and connected for rotary movement to said first output member of the differential motion transmission unit.

21. A typewriter according to claim 16, in which the character-carrying element is formed by a disc with flexible character-carrying blades, and said selector shaft constitutes a mounting shaft for said disc and wherein said mounting shaft is synchronous in respect of rotary movement with said second output member.

22. A typewriter according to claim 16, further comprising a correction device mounted on the carriage and actuable to interpose a correction ribbon between the character-carrying element and the roller and correct the typed characters by re-striking; and a motion switching mechanism which can be connected to the second output member and which is controlled by said electronic controlling arrangement for driving said correction device.

23. A typewriter according to claim 16, comprising a line spacing mechanism for rotation of the roller, and in which said actuating motor is mounted on a frame structure of the machine and wherein there are provided connecting means between said motor and said drive shaft for rotating said drive shaft in any position of the carriage along the printing line and a line spacing coupling controlled by said electronic controlling arrangement for actuating said line spacing device by means of said motor.

24. A typewriter according to claim 16, in which the actuating motor has a stator mounted on a fixed support, the drive shaft is connected in respect of rotary movement to a pinion rotatable on the carriage, and wherein there is provided a toothed belt which is supported in such a way as to have a run thereof which extends along the printing line to transmit the motion from a rotor of the actuating motor to said drive shaft by means of said pinion.

25. A typewriter according to claim 16, further comprising a typing ribbon feed device for advancing a portion of the typing ribbon in anticipation of printing of another character, and connecting means between said electromagnetic means and said feed device for driving said feed device in response to any actuation of said electromagnetic means for displacement of the first and second stop means.

26. A typewriter according to claim 25, in which said electromagnetic means have an actuator which is common to the first and second stop members and said feed device comprises a feed shaft, a gear assembly connected to said feed shaft and two ratchet members operatively connected to said common actuator and capable of alternately engaging one of two opposite teeth of said gear assembly for producing unidirectional feed movement of the feed shaft and said ribbon for half a feed step in response to displacement of the first stop member from the rest position to the operative position and for a second half of a feed step corresponding to a displacement of the stop member from the operative position to the rest position.

27. A typewriter according claim 22, in which said switching mechanism comprises a drive member for driving cam means and cam follower means of said correction device and switching control means which are actuable into an operative state for connecting said selector shaft to said drive member in respect of rotary movement and wherein said correction device comprises guide means for guiding a portion of correction ribbon between the character-carrying element and the roller and capable of displacement from an inoperative position in which the correction ribbon is removed from a typing point to an operative position in which the correction ribbon is in front of the typing point and wherein said cam means are connected in respect of rotary movement to said drive member and said cam follower means are co-operable with said cam means for displacing said guide means from the inoperative position to the operative position in response to the rotary movement of said cam means from an inoperative position to an operative position; wherein the rotary movement of said cam means from the operative position to the inoperative position is associated with a rotary movement of the character-carrying element in a given direction of movement, included in a preset out-of-phase value; and wherein the electronic controlling arrangement controls the correction device for a correction cycle of the typed character to be corrected, which provides for a preliminary rotary movement of the character-carrying element of a value equal and opposite to the out-of-phase value, and actuation of said control means and subsequent rotation of the drive member for an angle associated with the out-of-phase value of said character-carrying element.

28. A typewriter according to claim 27, in which said motion switching mechanism comprises a coupling having a drive portion connected for rotary movement to said selector shaft, a driven portion connected for rotary movement to said drive member and a coupling closure element mounted on said driven portion for connecting the drive portion and the driven portion together in respect of rotary movement and capable of disengaging the driven portion from the drive portion in a predetermined angular position of the driven portion, by means of a corresponding command controlled by the electronic controlling arrangement, for actuating a cycle of rotation of said drive member.

29. A typewriter according to claim 16, the actuating motor is of the stepping type and the electronic controlling arrangement controls said motor for a number of steps of the drive shaft which is different for the rotary movement of the first and second output members.

30. An electronic typewriter comprising:

a platen roller;

a frame structure on which the roller is supported;

a carriage which is guided slidably on corresponding guide means along a printing line parallel to the roller, wherein said carriage supports an electric actuating motor, a rotatable character-carrying element, a transport device for movement of the carriage, and a selector device for selection of one of the characters to be typed, wherein said motor powers said transport and selector devices;

an electronic controlling arrangement which is actuable for controlling the transport and selector devices and for controlling said motor;

a motion switching mechanism which can be connected to said motor and which is controlled by the electronic controlling arrangement for driving a drive member supported by the carriage; and a line spacing device for actuating line spacing cycles of said roller comprising an execution mechanism having an input lever mounted on the frame structure for oscilating movement about an axis parallel to the printing line, an actuating lever mounted on the carriage for oscillating movement about an axis of oscillation parallel to said printing line and a bar which connects said actuating lever and said input lever in respect of rotary movement in any position of the carriage along the printing line; and a fixed coupling means between said bar and said input lever and slidable coupling means between said actuating lever and said bar.

31. An electronic typewriter comprising:

a platen roller;

a carriage movable along a printing line parallel to the roller and on which is mounted a character-carrying element, a drive shaft, a transport member actuated by the drive shaft for displacing said carriage forward and backwards along the printing line and a function device also requiring backwards displacement of the carriage;

an electric actuating motor for rotating the drive shaft;

connecting means between the drive shaft, the transport member and the function device;

an electronic controlling arrangement actuable for controlling said transport device and said function device;

a differential motion transmission unit having an input member connected for rotary movement to said drive shaft and first and second output members for respectively driving the transport member and the function device requiring backward displacement of the carriage;

electromagnetic means controlled by the electronic controlling arrangement for defining a first state in which the second output member is stopped and at the same time motion is transmitted from the drive shaft to the first output member or alternatively for defining a second state in which the first output member is stopped and the motion is transmitted to the second output member;

a coupling-type motion switching mechanism for actuating said function device, said switching mechanism comprising a drive portion connected for rotary movement to the second output member, a driven portion for driving said function device and a coupling closure element for connecting the drive portion and the driven portion together in respect of rotary movement;

a control element capable of operating on said closure element to disengage the driven portion from the drive portion in a predetermined angular position of the driven portion and vice-versa to permit closure of said coupling; and an actuating mechanism connected to the first output member and operative on said control element in response to a cycle involving return of the carriage by a step along said printing line;

wherein said electronic controlling arrangement is capable actuating a sequence which provides for defining the first state of the electromagnetic means and activation of said motor for effecting the return movement of the carriage by a step and closing said coupling by means of said actuating mechanism and said control element;

wherein said electronic controlling arrangement is capable of actuating a second sequence which is subsequent to the first sequence, which provides for definition of the second state of the electromagnetic means and activation of said motor for transmitting the motion to the second output member and to the driven portion of said motion switching mechanism for an actuation cycle of said function device.

32. A typewriter according to claim 31 comprising a line spacing mechanism for rotary movement of the roller, and in which said actuating motor is mounted on a frame structure of the machine and wherein there are provided connecting means between said motor and said drive shaft for rotating said drive shaft in any position of the carriage along the printing line and a line spacing coupling controlled by said electronic controlling arrangement for actuating said line spacing device by means of said motor.

33. A typewriter according to claim 31, in which said coupling closure element is spring-loaded for closure of said coupling and is held by said control element in an inactivity position in which the coupling is opened and the driven portion is at rest;

wherein said actuating mechanism comprises friction means having an input element which is entrained in rotation by said first output member, a driven portion which is frictionally coupled to said drive portion and connected to said control element and end-of-travel means for limiting the rotary movement of said driven portion;

wherein said friction means respond to a backwards displacement of the carriage to displace said control element into an operative position in which said control element causes closure of said coupling; and wherein said friction means respond to a displacement in the forward direction of the carriage to displace the control element into the inactivity position in which said control element opens the coupling of said switching mechanism after displacement of the carriage in a forward direction by one step.

34. A typewriter according to claim 33, in which in said friction means the input element comprises a toothed ratchet member supported rotatably on a support shaft of the carriage, being engaged with a tooth configuration of the second output member and provided with an output sleeve, wherein said driven portion comprises a rocker arm member capable of oscillating movement about said support shaft and provided with friction elements which are held in contact against said sleeve by means of a spring, and a projection which defines said control element and wherein said end-of-travel means comprise two counteracting elements of the rocker arm member, which are capable of being arrested by two corresponding stop surfaces of the carriage.

35. A typewriter according to claim 31, in which the actuating motor is of the stepping type and the electronic controlling arrangement controls said motor for a number of steps of the drive shaft which is different from those for the rotary movement of the first and second output members.

36. An electronic typewriter comprising:

a frame structure;

a platen roller supported by the frame structure;

a carriage displaceable along a printing line parallel to the roller and on which are mounted an electric motor having a drive shaft, a rotatable character-carrying element and a correction device for bringing a correction ribbon in front of the typing point for correction of a typed character by re-striking thereof;

an electronic controlling arrangement for controlling said motor, said correction device and the motion of the character-carrying element;

wherein said correction device comprises a correction actuator;

a motion switching mechanism having an input member connected in respect of rotary movement to said drive shaft and actuable under the control of the eletronic controlling arrangement for connecting a drive member to said input member in respect of rotary movement;

a line spacing device comprising a line spacing execution mechanism for rotating the roller and a line spacing actuator wherein said execution mechanism is supported by the frame structure and said line spacing actuator is supported by the carriage, and wherein there are provided connecting means between the line spacing actuator and the line spacing execution mechanism for transmitting the motion of the line spacing actuator to the execution mechanism in any position of the carriage;

first cam means and second cam means which are both connected in respect of rotary movement to said driven member and with which the correction actuator and the line spacing actuator are respectively capable of co-operating for driving the correction device and the line spacing device respectively; and change means which are responsive to the direction of movement of said drive member for alternately disengaging the correction actuator from the first cam means for a first direction of rotation of said drive member or disengaging the line spacing actuator from said second cam means in a direction of movement of the drive member which is opposite to said first direction of movement; and wherein said electronic controlling arrangement comprises means for activating said motor for rotating said drive member in said first direction of rotation for driving the line spacing device or for rotating the drive member in the opposite direction of movement for driving the correction device and for effecting a line spacing cycle or a correction cycle respectively.

37. An electronic typewriter according to claim 36, further comprising a transport member for displacement of the carriage, a selector shaft for rotation of said character-carrying member, which are both mounted on said carriage, a motion transmission unit having an input member connected for rotary movement to the drive shaft and a first output member and a second output member for respectively driving said transport member and said selector member, wherein said electronic controlling arrangement controls said transmission unit for transmitting the motion from said drive shaft to the first output member or alternatively for transmitting the motion to the second output member, and wherein the input member of said motion switching mechanism is connected in respect of rotary movement to said second output member.

38. An electronic typewriter according to claim 37, in which said motion switching mechanism comprises a coupling having a drive portion formed by said input member, a driven portion connected for rotary movement to said driven member and a coupling closure element mounted on the driven portion for connecting the drive portion and the driven portion together in respect of rotary movement, and wherein said closure element is capable of disengaging the driven portion from the drive portion in a predetermined angular position of the driven portion, by means of a corresponding control controlled by the electronic controlling arrangement, for actuating a cycle of rotation of said driven member.

* * * * *